US006521401B1

(12) United States Patent
Yamashita et al.

(10) Patent No.: US 6,521,401 B1
(45) Date of Patent: Feb. 18, 2003

(54) SILVER HALIDE PHOTOGRAPHIC EMULSION AND SILVER HALIDE PHOTOGRAPHIC MATERIAL

(75) Inventors: Katsuhiro Yamashita, Kanagawa (JP); Katsumi Kobayashi, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 09/631,994

(22) Filed: Aug. 3, 2000

(30) Foreign Application Priority Data

Aug. 4, 1999 (JP) ..... 11-221479

(51) Int. Cl.[7] ..... G03C 1/005; G03C 1/494

(52) U.S. Cl. ..... 430/584; 430/504; 430/567; 430/570; 430/572; 430/574; 430/581; 430/585; 430/583

(58) Field of Search ..... 430/504, 567, 430/572, 583, 570, 574, 581, 585, 584

(56) References Cited

U.S. PATENT DOCUMENTS 5,866,315 A * 2/1999 Hoet et al. ..... 430/583
6,048,681 A * 4/2000 Suzumoto et al. ..... 430/570
6,117,629 A * 9/2000 Yamashita et al. ..... 430/570
6,180,332 B1 * 1/2001 Yamashita et al. ..... 430/574
6,333,146 B1 * 12/2001 Kobayashi et al. ..... 430/570

FOREIGN PATENT DOCUMENTS

EP 0838719 A2 4/1998

* cited by examiner

*Primary Examiner*—Geraldine Letscher
(74) *Attorney, Agent, or Firm*—Sughrue Mion, PLLC

(57) ABSTRACT

A silver halide photographic emulsion which contains silver halide grains having a spectral absorption maximum wavelength of less than 500 nm and a light absorption strength of 60 or more, or a spectral absorption maximum wavelength of 500 nm or more and a light absorption strength of 100 or more, wherein at least one of the sensitizing dyes which are used for spectrally sensitizing the emulsion does not have an electric charge in the molecule at all, or forms an inner salt and the molecule does not have an electric charge as a whole and has at least one aromatic ring in the molecule.

12 Claims, No Drawings

SILVER HALIDE PHOTOGRAPHIC EMULSION AND SILVER HALIDE PHOTOGRAPHIC MATERIAL

FIELD OF THE INVENTION

The present invention relates to a spectrally sensitized silver halide photographic material.

BACKGROUND OF THE INVENTION

A great effort has been expended for increasing the sensitivity of silver halide photographic materials. It is thought that the transmission efficiency of light energy to silver halide is improved by increasing the light absorption rate of the dye for use in spectral sensitization of silver halide, as a result, the improvement of spectral sensitivity can be attained.

However, there is a limit to the adsorption amount of a sensitizing dye onto the surface of a silver halide grain. Ordinary sensitizing dyes are adsorbed onto silver halide grains in almost closest packing by a monolayer, therefore, it is difficult to make adsorb onto a silver halide grain the dye chromophore of the amount more than the monolayer saturation adsorption (i.e., the adsorption by a single layer) completely covering the surfaces of a silver halide grain. That is, even if sensitizing dyes of the amount more than the amount of the monolayer saturation adsorption is added, it means the mere increase of non-adsorbed dyes. Therefore, in the present situation, the absorption rate of the incident light quantum of each silver halide grain in the spectral sensitization region is still low.

The means suggested to solve these problems will be described below.

P. B. Gilman, Jr. et al. made a cationic dye adsorb onto the first layer and an anionic dye onto the second layer by electrostatic force as described in *Photographic Science and Engineering,* Vol. 20, No. 3, page 97 (1976).

G. B. Bird et al. made a plurality of dyes multilayer-adsorb onto silver halide to effect sensitization by virtue of the transfer of Forster type excitation energy as disclosed in U.S. Pat. No. 3,622,316.

Sugimoto et al. performed spectral sensitization by energy transfer from a luminescent dye as disclosed in JP-A-63-138341 and JP-A-64-84244 (the term "JP-A" as used herein means an "unexamined published Japanese patent application").

R. Steiger et al. tried spectral sensitization by energy transfer from a gelatin-substituted cyanine dye as described in *Photographic Science and Engineering,* Vol. 27, No. 2, page 59 (1983).

Ikekawa et al. performed spectral sensitization by energy transfer from a cyclodextrin-substituted dye as disclosed in JP-A-61-251842.

So-called connecting dyes having two chromophores which are not conjugated separately and connected by a covalent bond are disclosed in U.S. Pat. Nos. 2,393,351, 2,425,772, 2,518,732, 2,521,944, 2,592,196 and European Patent 565083. However, these dyes were not dyes aiming at the improvement of light absorption rate. As the dyes aiming at the improvement of light absorption rate actively, G. B. Bird, A. L. Borror et al. made connecting type sensitizing dye molecules having a plurality of cyanine chromophores adsorb onto silver halide to heighten the light absorption rate and contrived sensitization by the contribution of energy transfer as disclosed in U.S. Pat. Nos. 3,622,317 and 3,976,493 Ukai, Okazaki and Sugimoto proposed in JP-A-64-91134 to connect at least one substantially non-adsorptive cyanine, merocyanine or hemicyanine dye containing at least two sulfo groups and/or carboxyl groups to a spectral sensitizing dye adsorbable onto silver halide.

L. C. Vishwakarma disclosed in JP-A-6-57235 a method of synthesizing a connecting dye by a dehydration condensation reaction of two dyes. Further, L. C. Vishwakarma showed in JP-A-6-27578 that a connecting dye comprising monomethine cyanine and pentamethine oxonol had red-sensitivity, but in this case spectral sensitization due to Forster type excitation energy transfer between dyes was not effected because the luminescence of the oxonol dye did not overlap with the absorption of the cyanine dye. Therefore, higher sensitization by the light converging function of the connected oxonol cannot be obtained.

R. L. Parton et al. suggested a connecting dye having a specific linking group in EP-A-887770.

M. R. Roberts et al. suggested spectral sensitization by a cyanine dye polymer in U.S. Pat. No. 4,950,587.

As described above, numerous examinations have been conducted heretofore for the improvement of light absorption rate, but none of them was satisfactory in higher sensitization effect and there remained such problems as the increase of intrinsic desensitization and development inhibition.

In a color photographic material, in particular, it is necessary to make spectral sensitivity stay within an objective wavelength region. In spectral sensitization of a silver halide photographic material, J-band which is formed when a sensitizing dye is adsorbed onto a silver halide grain surface, is generally utilized without the use of the absorption of a sensitizing dye in a monomer state. Since J-band of a sensitizing dye has sharper absorption band shifted to the long wavelength side more than that in a monomer state, it is very useful to make a light absorption band and a spectral sensitivity band stay in the desired wavelength region. Hence, even if the light absorption rate can be increased by multilayer-adsorption of a sensitizing dye onto a grain surface, when the dye of the layers on and after the second layer which is not directly adsorbed onto the silver halide grain is adsorbed in the state of a monomer, a very broad absorption band is brought about, which is inappropriate as the spectral sensitivity of a practical photographic material.

On the other hand, each color sensitivity region has the width of about 100 nm, and it is not preferred for each light in that range to generate unnecessarily large sensitivity difference. Therefore, the techniques for increasing the strength of a light absorbing area per unit surface area of a silver halide grain by the multilayer-adsorption of a sensitizing dye onto the silver halide grain surface with limiting the absorption and spectral sensitivity to the desired width of color sensitivity region and still with making spectral absorption rate and sensitivity change of the light in the same range as small as possible have been desired.

It has been found that when a sensitizing dye is multilayer-adsorbed onto the surface of a silver halide grain, the adsorption amount of gelatin decreases and the property of protective colloid lowers, hence the agglomeration of particles is liable to occur sometimes. Therefore, the techniques of multilayer-adsorbing a sensitizing dye onto a silver halide grain and at the same time suppressing the agglomeration of grains has been demanded.

As a result of eager investigation to adsorb one or more layers of dye chromophores onto a silver halide grain, the present inventors have already found that one or more layers of dye chromophores can be adsorbed onto a silver halide grain by various methods, e.g., the method of using a dye having an aromatic group or a cationic dye having an aromatic group with an anionic dye in combination as disclosed in JP-A-10-239789, JP-A-8-269009, JP-A-10-123650 and JP-A-8-328189; the method of using a dye having poly-electric charges as disclosed in JP-A-10-171058; the method of using a dye having a pyridinium group as disclosed in JP-A-10-104774; the method of using a dye having a hydrophobic group as disclosed in JP-A-10-186559; and the method of using a dye having a coordinate bonding group as disclosed in JP-A-10-107980.

However, the sensitizing dyes for use in these methods are dyes having limiting structures, therefore, it is desired for higher sensitization to widen these techniques to make multilayer adsorption possible even with the dyes having the structures other than the structures of these dyes.

SUMMARY OF THE INVENTION

The objects of the present invention are to provide a high speed silver halide photographic material where agglomeration of grains is inhibited, to provide a silver halide emulsion for use therefor, and to provide a sensitizing dye necessary therefor.

According to the present invention, the multilayer adsorption structure of a dye can also be formed by using a betaine dye as a spectral sensitizing dye to be used, thereby the objects of the present invention, a high speed silver halide photographic material a silver halide emulsion and a sensitizing dye therefor, can be provided. That is, the objects of the present invention have been achieved by the following embodiments (1) to (9).

(1) A silver halide photographic emulsion which contains silver halide grains having a spectral absorption maximum wavelength of less than 500 nm and light absorption strength of 60 or more, or a spectral absorption maximum wavelength of 500 nm or more and light absorption strength of 100 or more, wherein at least one of the sensitizing dyes which are used for spectrally sensitizing the emulsion does not have an electric charge in the molecule at all, or forms an inner salt and the molecule does not have an electric charge as a whole and has at least one aromatic ring in the molecule.

(2) The silver halide photographic emulsion as described in the above item (1), wherein said sensitizing dye is a compound represented by the following formula (I):

(I)

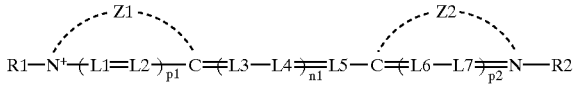

wherein Z1 and Z2 each represents an atomic group necessary to form a 5- or 6-membered nitrogen-containing heterocyclic ring, provided that Z1 and Z2 may be condensed with a ring; R1 and R2 each represents an alkyl group, an aryl group, or a heterocyclic group, and at least one of R1 and R2 is a group containing at least one aromatic group; L1, L2, L3, L4, L5, L6 and L7 each represents a methine group; p1 and p2 each represents 0 or 1; and n1 represents 0, 1, 2 or 3; provided that the dye represented by formula (I) has at least one anionic substituent necessary to form an inner salt and does not have electric charge as a whole.

(3) The silver halide photographic emulsion as described in the above item (1) or (2), wherein when the maximum value of the spectral absorption rate of said emulsion due to the sensitizing dye is taken as A max, the wavelength interval between the shortest wavelength and the longest wavelength showing 80% of A max is 20 nm or more and the wavelength interval between the shortest wavelength and the longest wavelength showing 50% of A max is 120 nm or less.

(4) The silver halide photographic emulsion as described in the above item (1) or (2), wherein when the maximum value of the spectral sensitivity of said emulsion due to the sensitizing dye is taken as S max, the wavelength interval between the shortest wavelength and the longest wavelength showing 80% of S max is 20 nm or more and the wavelength interval between the shortest wavelength and the longest wavelength showing 50% of S max is 120 nm or less.

(5) The silver halide photographic emulsion as described in the above item (3), wherein the longest wavelength showing the spectral absorption rate of 50% of A max is from 460 to 510 nm, or from 560 to 610 nm, or from 640 to 730 nm.

(6) The silver halide photographic emulsion as described in the above item (4), wherein the longest wavelength showing the spectral sensitivity of 50% of S max is 460 to 510 nm, or from 560 to 610 nm, or from 640 to 730 nm.

(7) A silver halide photographic material which has at least one silver halide photographic emulsion layer, wherein said silver halide photographic material contains the silver halide photographic emulsion as described in any of the above items (1) to (6).

(8) A compound represented by formula (I), wherein R1 and R2 each represents a group containing at least one aromatic group.

(9) A silver halide photographic material which contains at least one compound as described in the above item (8).

DETAILED DESCRIPTION OF THE INVENTION

The present invention will be described in detail below.

The present invention relates a silver halide photographic emulsion using silver halide grains which are sensitized by a sensitizing dye, which has large light absorption strength, an appropriate spectral absorption wave form, and sensitivity distribution.

In the present invention, the light absorption strength is the strength of a light absorption area by a sensitizing dye per a unit grain surface area, and is defined as, when taking the quantum of light to be subjected to incidence to the unit surface area of a grain as $I_0$, and the quantum of light to be absorbed by a sensitizing dye at the surface as I, the value obtained by integrating optical density Log $[I_0/(I_0-I)]$ to the wave number ($cm^{-1}$) The range of integration is from 5,000 $cm^{-3}$ to 35,000 $cm^{-1}$.

It is preferred for the silver halide photographic emulsion according to the present invention to contain ½ or more of the projected area of the entire silver halide grains of silver halide grains having light absorption strength of 100 or more when the grains have a spectral absorption maximum wavelength of 500 nm or more, and silver halide grains having light absorption strength of 60 or more when the grains have a spectral absorption maximum wavelength of less than 500 nm. Further, when the spectral absorption maximum wavelength of the silver halide grains exceeds 500 nm, the light absorption strength is preferably 150 or more, more preferably 170 or more, and particularly preferably 200 or more, and when the spectral absorption maximum wavelength of the silver halide grains is less than 500 nm, the light absorption strength is preferably 90 or more, more preferably 100 or more, and particularly preferably 120 or more. The upper limit of the light absorption strength is not particularly limited but is preferably 2,000 or less, more preferably 1,000 or less, and particularly preferably 500 or less.

With respect to the silver halide grains having a spectral absorption maximum wavelength of less than 500 nm, the spectral absorption maximum wavelength is preferably 350 nm or more.

Light absorption strength can be measured, e.g., with a microspectrophotometer. A microspectrophotometer is an apparatus capable of measuring the absorption spectrum of a minute area, and capable of measuring the transmission spectrum of one grain. with respect to the measurement of the absorption spectrum of one grain by a microspectral method, Yamashita et al., *The Substances of the Lectures in Annual Meeting in* 1996, Nihon Shashin Gakkai, p. 15 can be referred to. The absorption strength per one grain can be obtained from the absorption spectrum. Since the light which transmits a grain is absorbed at two planes of an upper plane and a lower plane, the light absorption strength per a unit area of a grain surface can be obtained as ½ of the absorption strength per one grain obtained by the above method. The range of the integration of absorption spectrum is from 5,000 $cm^{-1}$ to 35,000 $cm^{-1}$ in the definition of light absorption strength, but range of the integration may be the range including about 500 $cm^{-1}$ where a sensitizing dye has absorption from the experimental point of view.

The light absorption strength can also be found without using the microspectral method by measuring transmission spectrum by juxtaposing grains closely but so as not to overlap with each other.

The light absorption strength is a value determined univocally by the oscillator strength of a sensitizing dye and the ad-molecule number per a unit area, hence the light absorption strength is convertible from the oscillator strength of a sensitizing dye, the adsorption amount of a dye and the surface area of a grain.

As the oscillator strength of a sensitizing dye can be obtained experimentally as a value proportional to the absorption area strength of a sensitizing dye solution (optical density×$cm^{-1}$), the light absorption strength can be obtained according to the following equation with the errors of about 10% with taking the absorption area strength of a sensitizing dye per 1 M as A (optical density×$cm^{-1}$), the adsorption amount of a sensitizing dye as B (mol/mol Ag), and the surface area of a grain as C ($m^2$/mol Ag):

$$0.156 \times A \times B/C$$

The light absorption strength found from the above equation is substantially coincide with the value obtained by integrating the light absorption strength measured according to the above definition $[\mathrm{Log}(I_0/(I_0-I))]$ to wavelength ($cm^{-1}$).

Light absorption strength can be increased by a method of making one or more layers of a dye chromophore adsorb onto a grain surface, a method of increasing the molecular absorption coefficient of a dye, or a method of making the occupied area of a dye small, and any of these methods can be used, but a preferred method is a method of making a dye chromophore adsorb onto a grain surface in one or more layers.

Herein, "the state of a dye chromophore being adsorbed onto a grain surface in one or more layers" means that one or more layers of a dye restricted to the vicinity of a silver halide grain are present and the dye in a dispersion medium is not included. Further, even when a dye chromophore is connected to the substance adsorbed onto a grain surface through a covalent bonding, if the linking group is long and the dye chromophore is present in the dispersion medium, the effect of enhancing the light absorption strength is small, therefore, such a case is not included in the adsorption of one or more layers. In the adsorption of one or more layers of a dye chromophore onto a grain surface, i.e., multilayer adsorption, it is necessary that spectral sensitization is brought about by the dye not directly adsorbed onto the grain surface and for that sake the transmission of exciting energy from the dye not directly adsorbed onto the grain to the dye directly adsorbed onto the grain is necessary. Accordingly, when the transmission of exciting energy requires to occur through ten or more stages, the final transmission rate of exciting energy disadvantageously reduces. As one of such examples, e.g., the polymer dye as disclosed in JP-A-2-113239, in which almost all the moiety of the dye chromophore exists in a dispersion medium and the transmission of exciting energy requires ten or more stages can be exemplified.

In the present invention, the number of stages necessary for dye coloring per one molecule is preferably from 1 to 3.

The chromophore described herein means an atomic group which is a main cause of absorption band of a molecule as described in *Rikagaku Jiten* (*Physicochemical Thesaurus*), 4th Ed., pp. 985 to 986, Iwanami Shoten Co., Ltd. (1987), e.g., an atomic group having an unsaturated bond such as C═C or N═N, and any atomic group may be possible as the chromophore.

Examples of such chromophores include a cyanine dye, a styryl dye, a hemicyanine dye, a merocyanine dye, a trinuclear merocyanine dye, a tetranuclear merocyanine dye, a rhodacyanine dye, a complex cyanine dye, a complex merocyanine dye, an allopolar dye, an oxonol dye, a hemioxonol dye, a squarylium dye, a croconium dye, an azamethine dye, a coumarin dye, an arylidene dye, an anthraquinone dye, a triphenylmethane dye, an azo dye, azomethine dye, a spiro compound, a metallocene dye, a fluorenone dye, a fulgide dye, a perylene dye, a phenazine dye, a phenothiazine dye, a quinone dye, an indigo dye, a diphenylmethane dye, a polyene dye, an acridine dye, an acridinone dye, a diphenylamine dye, a quinacridone dye, a quinophthalone dye, a phenoxazine dye, a phthaloperylene dye, a porphine dye, a chlorophyll dye, a phthalocyanine dye, and a metallic complex dye.

Of these, polymethine chromophores such as a cyanine dye, a styryl dye, a hemicyanine dye, a merocyanine dye, a trinuclear merocyanine dye, a tetranuclear merocyanine dye, a rhodacyanine dye, and an allopolar dye are preferred, more preferred are a cyanine dye, a merocyanine dye and a rhodacyanine dye, and still more preferred are a cyanine dye and a merocyanine dye, and most preferred is a cyanine dye.

These dyes are described in detail in F. M. Harmer, *Heterocyclic Compounds—Cyanine Dyes and Related Compounds,* John Wiley & Sons, New York, London (1964), D. M. Sturmer, *Heterocyclic Compounds—Special Topics in Heterocyclic Chemistry,* Chap. 18, Clause 14, pp. 482 to 515. Formulae (XI), (XII) and (XIII) disclosed in U.S. Pat. No. 5,340,694, columns 21 and 22 are preferred as formulae of the cyanine, merocyanine and rhodacyanine dyes, respectively. However, the numbers of n12, n15, n17 and n18 are not restricted herein and regarded as 0 or more integers.

The number of the adsorption layers of dye chromophores to a silver halide grain is preferably 1.5 layers or more, more preferably 1.7 layers or more, and particularly preferably 2 layers or more. The upper limit is not particularly restricted but is preferably 10 layers or less, more preferably 5 layers or less.

In the present invention, when the saturated adsorption amount per a unit area attained by a dye having the smallest dye occupation area of the silver halide grain surface among the sensitizing dyes added to the emulsion is taken as one layer saturation covering amount, the state that one or more layers of the chromophore is adsorbed onto the surface of a silver halide grain means the state in which the adsorption amount of the chromophore per a unit area is more than the one layer saturation covering amount. The adsorption layer number means the adsorption amount with one layer saturation covering amount as the standard. In the case of a dye comprising dye chromophores connected by covalent bonding, the dye occupation area of each dye in the state of not being connected can be made standard.

The dye occupation area can be obtained from the adsorption isothermal line showing the relationship between a free dye density and an adsorption dye amount and the surface area of a grain. The adsorption isothermal line can be found by referring, for instance, to A. Herz et al., *Adsorption from Aqueous Solution* in Advances in Chemistry Series, No. 17, p. 173 (1968).

The adsorption amount of a sensitizing dye onto emulsion grains can be obtained from the following two methods, e.g., a method comprising centrifuging the emulsion onto which a dye is adsorbed, separating the emulsion into emulsion grains and a supernatant gelatin solution, obtaining the non-adsorbed dye density by spectral absorption determination of the supernatant and subtracting the thus-obtained non-adsorbed dye density from the addition amount of the dye to thereby obtain the adsorption amount of the sensitizing dye, and from a method comprising drying the precipitated emulsion grains, dissolving a specific weight of the precipitate in a mixed solution (1/1) of an aqueous sodium thiosulfate solution and methanol, and obtaining the adsorbed amount of the dye by spectral absorption determination. When a plurality of sensitizing dyes are used, the adsorption amount of each dye can also be found, for example, by high speed liquid chromatography. A method of obtaining a dye adsorption amount by determining the dye amount in a supernatant is described, for example, in W. West et al., *Journal of Physical Chemistry,* Vol. 56, p.1054 (1952). However, when large amounts of dyes are added, even non-adsorbed dyes sometimes precipitate, hence a correct adsorption amount cannot necessarily be obtained by the method of measuring the dye density in a supernatant. On the other hand, with the method of dissolving precipitated silver halide grains and determining the dye adsorption amount, as the precipitation speed of emulsion grains is overwhelmingly faster than that of a dye, thus the emulsion grains and the dye can be separated easily, and only the amount of the dye adsorbed onto the silver halide grains can be correctly determined, and this method is the most reliable method for obtaining the dye adsorption amount.

As one example of measuring methods of a silver halide grain surface area, a method of calculating a form and size of each grain from a transmission electromicrophotograph by a replica method is available. In this case, the thickness of a tabular grain is calculated from the length of the shadow of a replica. As for the photographing method of a transmission electromicrophotograph, compiled by Nihon Denshi Kenbikyo Gakkai Kanto Branch, *Denshi Kenbikyo Shiryo Gijutsu-Shu,* published by Seibundo Shinkosha Co., Ltd. (1970) and P. B. Hirsch et al., *Electron Microscopy of Thin Crystals,* Butterworths, London (1965) can be referred to.

As other methods, e. g., A. M. Kragin et al., *The Journal of Photographic Science,* Vol. 14, p. 185 (1966), J. F. Paddy, *Transactions of the Faraday Society,* Vol. 60, p. 1325 (1964), S. Boyer et al., *Journal de Chimie Physique et de Physicochimie Biologique,* Vol. 63, p. 1123 (1963), W. West et al., *Journal of Physical Chemistry,* Vol. 56, p. 1054 (1952), compiled by H. Sauvenier, E. Klein et al., *International Coloquim,* Liege (1959), and *Scientific Photography* can be referred to.

The dye occupation area can be obtained by the above methods as to individual case experimentally, but since the molecule occupation area of generally used sensitizing dyes is about 80 $Å^2$, adsorption layer number can be estimated roughly with taking the dye occupation area of all the dyes as 80 $Å^2$ for convenience' sake.

When dye chromophores are multilayer-adsorbed onto silver halide grains in the present invention, the reduction potentials and oxidation potentials of the chromophore of the so-called first layer and the chromophores of on and after the second layer are not particularly restricted, but it is preferred that the value of the reduction potential of the chromophore of the first layer is higher than the value obtained by subtracting 0.2 from the value of the reduction potential of the chromophore of on and after the second layer.

Reduction potential and oxidation potential can be measured by various methods but a measuring method by phase discriminating second harmonic AC polarography is preferred, by which a correct value can be obtained. The method of measuring the oxidation potential according to phase discriminating second harmonic AC polarography is described in *Journal of Imaging Science,* Vol. 30, p. 27 (1986).

Further, dye chromophores of on and after the second layer are preferably luminescent dyes. As the kinds of luminescent dyes, those having skeletons (i.e., basic structure) of dyes which are used for dye laser are preferred. Such luminescent dyes are described, for example, in Mitsuo Maeda, *Laser Kenkyu* (*Study of Laser*), Vol. 8, pp. 694, 803 and 958 (1980), and Vol. 9, p. 85 (1981), and F. Sehaefer, *Dye Lasers,* Springer (1973).

It is preferred that the absorption maximum wavelength of the chromophore of the first layer in a silver halide photographic material is longer than the absorption maximum wavelength of the chromophore of on and after the second layer. Further, it is preferred that the light emission of on and after the second layer overlaps the absorption of the chromophore of the first layer. It is preferred for the chromophore of the first layer to form a J-association body (i.e., J-aggregate) . Moreover, for silver halide grains to have absorption and spectral sensitivity in a desired wavelength region, it is also preferred for the chromophore of on and after the second layer to form a J-association body (J-aggregate).

The meanings of the terminologies for use in the present invention are described below.

Dye occupation area: The occupation area per a molecule of a dye. The dye occupation area can be obtained experimentally from the adsorption isothermal line. In the case of a dye comprising dye chromophores connected by covalent bonding, the dye occupation area of each dye in the state of not being connected is made standard. It is regarded as 80 $Å^2$ for convenience' sake.

One layer saturation covering amount: The adsorption amount of a dye per a unit surface area of a silver halide grain at one layer saturation covering, which is a reciprocal of the occupation area attained by a dye having the smallest dye occupation area among the sensitizing dyes added to the emulsion.

Multilayer adsorption: The state in which the adsorption amount of a dye chromophore per a unit surface area of a grain is more than the one layer saturation covering amount.

Adsorption layer number: The adsorption layer number means the adsorption amount of a dye chromophore per a unit surface area of a grain when the one layer saturation covering amount is taken as the standard.

The interval between the shortest wavelength and the longest wavelength respectively showing 50% of the maximum value of spectral absorption rate A max and the maximum value of spectral sensitivity S max by a sensitizing dye of the emulsion containing silver halide photographic emulsion grain having light absorption strength of 100 or more is preferably 100 nm or less.

The interval between the shortest wavelength and the longest wavelength respectively showing 80% of A max and S max is 20 nm or more, preferably 100 nm or less, more preferably 80 nm or less, and most preferably 50 nm or less.

The interval between the shortest wavelength and the longest wavelength respectively showing 20% of A max and S max is preferably 180 nm or less, more preferably 150 nm or less, particularly preferably 120 nm or less, and most preferably 100 nm or less.

A method for forming silver halide grains having a spectral absorption maximum wavelength of less than 500 nm and light absorption strength of 60 or more, or a spectral absorption maximum wavelength of 500 nm or more and light absorption strength of 100 or more is disclosed in the specification of the present invention, which comprises using a dye which does not have an electric charge in the molecule at all, or forms an inner salt and the molecule does not have an electric charge as a whole and has at least one aromatic ring in the molecule.

Examples of the aromatic rings include an aromatic hydrocarbon ring, a condensed polycyclic aromatic hydrocarbon ring, and an aromatic heterocyclic ring, and these rings may further be substituted with the substituent V described below or may form a condensed ring. Examples of the preferred aromatic rings include benzene, naphthalene, anthracene, phenanthrene, fluorene, triphenylene, naphthacene, biphenyl, pyrrole, furan, thiophene, imidazole, oxazole, thiazole, pyridine, pyrazine, pyrimidine, pyridazine, indolizine, indole, benzofuran, benzothiophene, isobenzofuran, quinolizine, quinoline, phthalazine, naphthyridine, quinoxaline, quinoxazoline, cinnoline, carbazole, phenanthridine, acridine, phenanthroline, thianthrene, chromene, xanthene, phenoxathiin, phenothiazine, and phenazine.

As the dyes, examples include spiro compounds, compounds such as metallocene, fluorenone, fulgide, imidazole, perylene, phenazine, phenothiazine, polyene, azo, disazo, quinone, indigo, diphenylmethane, triphenylmethane, polymethine, acridine, acridinone, carbostyryl, coumarin, diphenylamine, quinacridone, quinophthalone, phenoxazine, xanthene, oxazine, thiazine, phthaloperylene, porphine, chlorophyll, phthalocyanine, squarylium, diazobenzene, and bipyridine metallic complex, preferred of these are compounds such as azo, diphenylmethane, triphenylmethane, polymethine, porphine, phthalocyanine, squarylium, and bipyridine metallic complex, and more preferred is polymethine.

Any polymethine dye can be used, and preferred examples thereof include a cyanine dye, a merocyanine dye, a rhodacyanine dye, an oxonol dye, a trinuclear merocyanine dye, a tetranuclear merocyanine dye, an allopolar dye, a styryl dye, a styryl-based dye, a hemicyanine dye, a streptocyanine dye, and a hemioxonol dye, preferred are a cyanine dye, a merocyanine dye, and a rhodacyanine dye, and more preferred is a cyanine dye (electric charge is betaine state). These dyes are described in detail in F. M. Harmer, *Heterocyclic Compounds—Cyanine Dyes and Related Compounds,* John Wiley & Sons, New York, London (1964), D. M. Sturmer, *Heterocyclic Compounds—Special Topics in Heterocyclic Chemistry,* Chap. 18, Clause 14, pp. 482 to 515.

In a dye represented by formula (I), a cyanine dye having a basic nucleus comprising a condensed ring of three or more rings is particularly preferably used in the present invention. As the basic nucleus comprising a condensed ring of three or more rings, any basic nucleus of polycyclic condensed type heterocyclic ring comprising a condensed ring of three or more rings may be used, preferably a tricyclic condensed heterocyclic ring and a tetracyclic heterocyclic ring can be exemplified.

Preferred examples of the tricyclic condensed heterocyclic rings include naphtho[2,3-d]oxazole, naphtho[1,2-d]oxazole, naphtho[2,1-d]oxazole, naphtho[2,3-d]thiazole, naphtho[1,2-d]thiazole, naphtho[2,1-d]thiazole, naphtho[2,3-d]imidazole, naphtho[1,2-d]imidazole, naphtho[2,1-d]imidazole, naphtho[2,3-d]selenazole, naphtho[1,2-d]selenazole, naphtho[2,1-d]selenazole, indolo[5,6-d]oxazole, indolo[6,5-d]oxazole, indolo[2,3-d]oxazole, indolo[5,6-d]thiazole, indolo[6,5-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[6,5-d]thiazole, benzofuro[2,3-d]thiazole, benzothieno[5,6-d]oxazole, benzothieno[6,5-d]oxazole, and benzothieno[2,3-d]oxazole.

Preferred examples of the tetracyclic condensed heterocyclic rings include anthra[2,3-d]oxazole, anthra[1,2-d]oxazole, anthra[2,1-d]oxazole, anthra[2,3-d]thiazole, anthra[1,2-d]thiazole, phenanthro[2,1-d]thiazole, phenanthro[2,3-d]imidazole, anthra[1,2-d]imidazole, anthra[2,1-d]imidazole, anthra[2,3-d]selenazole, phenanthro[1,2-d]selenazole, phenanthro[2,1-d]selenazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, benzofuro[5,6-d]oxazole, dibenzothieno[2,3-d]oxazole, dibenzothieno[3,2-d]oxazole, tetrahydrocarbazolo[6,7-d]oxazole, tetrahydrocarbazolo[7,6-d]oxazole, dibenzothieno[2,3-d]thiazole, dibenzothieno[3,2-d]thiazole, and tetrahydrocarbazolo[6,7-d]thiazole.

More preferred examples of the basic nuclei comprising a condensed ring of three or more rings include naphtho[2,3-d]oxazole, naphtho[1,2-d]oxazole, naphtho[2,1-d]oxazole, naphtho[2,3-d]thiazole, naphtho[1,2-d]thiazole, naphtho[2,1-d]thiazole, indolo[5,6-d]oxazole, indolo[6,5-d]oxazole, indolo[2,3-d]oxazole, indolo[5,6-d]thiazole, indolo[2,3-d]thiazole, benzofuro[5,6-d]oxazole, benzofuro[6,5-d]oxazole, benzofuro[2,3-d]oxazole, benzofuro[5,6-d]thiazole, benzofuro[2,3-d]thiazole, benzothieno[5,6-d]oxazole, anthra[2,3-d]oxazole, anthra[1,2-d]oxazole, anthra[2,3-d]thiazole, anthra[1,2-d]thiazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno[2,3-d]oxazole, and dibenzothieno[3,2-d]oxazole, and particularly preferred examples include naphtho[2,3-d]oxazole, naphtho

[1,2-d]oxazole, naphtho[2,3-d]thiazole, indolo[5,6-d] oxazole, indolo[6,5-d]oxazole, indolo[5,6-d]thiazole, benzofuro[5,6-d]oxazole, benzofuro[5,6-d]thiazole, benzofuro[2,3-d]thiazole, benzothieno[5,6-d]oxazole, carbazolo[2,3-d]oxazole, carbazolo[3,2-d]oxazole, dibenzofuro[2,3-d]oxazole, dibenzofuro[3,2-d]oxazole, carbazolo[2,3-d]thiazole, carbazolo[3,2-d]thiazole, dibenzofuro[2,3-d]thiazole, dibenzofuro[3,2-d]thiazole, dibenzothieno [2,3-d]oxazole, and dibenzothieno [3,2-d] oxazole.

However, these dyes should be those which are in the state of betaine forming an inner salt or originally do not have an electric charge. Substituents necessary for forming an inner salt and neutralizing the electric charge in the molecule may be any anionic substituent and cationic substituent. As preferred substituents, the following groups can be exemplified.

As the anionic substituents, proton-dissociating acidic groups which dissociate 90% or more of proton at pH 6 to 8 can be exemplified, e.g., a sulfo group, a carboxyl group, a phosphoric acid group, and a boric acid group, preferably a sulfo group and a carboxyl group. As the cationic substituents, quaternary ammonium groups can be exemplified.

A plurality of anionic substituents and cationic substituents may be contained in the molecule of a dye but the dye molecule as a whole should be neutral not electrically charged.

The spectral absorption of the dye adsorbed onto on and after the second layer can be obtained by subtracting the spectral absorption by the dye of the first layer from the spectral absorption amount of the emulsion at large.

The spectral absorption by the dye of the first layer can be obtained by measuring the absorption spectrum of the time when the dye of the first layer alone is added. Further, the spectral absorption spectrum by the dye of the first layer can also be measured by adding a dye desorbing agent to the emulsion onto which sensitizing dyes are multilayer-adsorbed to thereby desorb the dye of on and after the second layer.

In the experiment of desorbing dyes from the surface of a grain with a dye desorbing agent, as the dye of the first layer is generally desorbed after the dyes of on and after the second layer have been desorbed, the spectral absorption by the dye of the first layer can be obtained if appropriate desorbing condition is selected, thereby it becomes possible to obtain the spectral absorption of the dyes of on and after the second layer. The method of using a dye desorbing agent is described in Asanuma et al., *Journal of Physical Chemistry B,* Vol. 101, pp. 2149 to 2153 (1997).

A sensitizing dye represented by formula (I) will be described in detail below.

In formula (I), Z1 and Z2 each represents an atomic group necessary to form a nitrogen-containing heterocyclic ring, provided that Z1 and Z2 may be condensed with an aromatic ring. The aromatic ring may be a heterocyclic ring such as a benzene ring, a naphthalene ring, a pyrazine ring, or a thiophene ring.

Examples of the nitrogen-containing heterocyclic rings include a thiazoline nucleus, a thiazole nucleus, a benzothiazole nucleus, an oxazoline nucleus, an oxazole nucleus, a benzoxazole nucleus, a selenazoline nucleus, a selenazole nucleus, a benzoselenazole nucleus, a 3,3-dialkylindolenine nucleus (e.g. 3,3-dimethylindolenine), an imidazoline nucleus, an imidazole nucleus, a benzimidazole nucleus, a 2-pyridine nucleus, a 4-pyridine nucleus, a 2-quinoline nucleus, a 4-quinoline nucleus, a 1-isoquinoline nucleus, a 3-isoquinoline nucleus, an imidazo[4,5-b]quinoxaline nucleus, an oxadiazole nucleus, a thiadiazole nucleus, a tetrazole nucleus, and a pyrimidine nucleus, preferred of these are a benzothiazole nucleus, a benzoxazole nucleus, a 3,3-dialkylindolenine nucleus (e.g., 3,3-dimethylindolenine), a benzimidazole nucleus, a 2-pyridine nucleus, a 4-pyridine nucleus, a 2-quinoline nucleus, a 4-quinoline nucleus, a 1-isoquinoline nucleus, and a 3-isoquinoline nucleus, still more preferred are a benzothiazole nucleus, a benzoxazole nucleus, a 3,3-dialkylindolenine nucleus (e.g., 3,3-dimethylindolenine), and a benzimidazole nucleus, particularly preferred are a benzoxazole nucleus, a benzothiazole nucleus, and a benzimidazole nucleus, and most preferred are a benzoxazole nucleus and a benzothiazole nucleus.

When the substituents on these nitrogen-containing heterocyclic rings is considered as V, the substituents represented by V are not particularly limited. Examples of V include, for example, a halogen atom (e.g., chlorine, bromine, iodine, fluorine), a mercapto group, a cyano group, a carboxyl group, a phosphoric acid group, a sulfo group, a hydroxyl group, a carbamoyl group having from 1 to 10, preferably from 2 to 8, and more preferably from 2 to 5, carbon atoms (e.g., methylcarbamoyl, ethylcarbamoyl, morpholinocarbonyl), a sulfamoyl group having from 0 to 10, preferably from 2 to 8, and more preferably from 2 to 5, carbon atoms (e.g., methylsulfamoyl, ethylsulfamoyl, piperidinosulfonyl), a nitro group, an alkoxyl group having from 1 to 20, preferably from 1 to 10, and more preferably from 1 to 8, carbon atoms (e.g., methoxy, ethoxy, 2-methoxyethoxy, 2-phenylethoxy), an aryloxy group having from 6 to 20, preferably from 6 to 12, and more preferably from 6 to 10, carbon atoms (e.g., phenoxy, p-methylphenoxy, p-chloro-phenoxy, naphthoxy), an acyl group having from 1 to 20, preferably from 2 to 12, and more preferably from 2 to 8, carbon atoms (e.g., acetyl, benzoyl, trichloroacetyl), an acyloxy group having from 1 to 20, preferably from 2 to 12, and more preferably from 2 to 8, carbon atoms (e.g., acetyloxy, benzoyloxy), an acylamino group having from 1 to 20, preferably from 2 to 12, and more preferably from 2 to 8, carbon atoms (e.g., acetylamino), a sulfonyl group having from 1 to 20, preferably from 1 to 10, and more preferably from 1 to 8, carbon atoms (e.g., methanesulfonyl, ethanesulfonyl, benzenesulfonyl), a sulfinyl group having from 1 to 20, preferably from 1 to 10, and more preferably from 1 to 8, carbon atoms (e.g., methanesulfinyl, ethanesulfinyl, benzenesulfinyl), a sulfonylamino group having from 1 to 20, preferably from 1 to 10, and more preferably from 1 to 8, carbon atoms (e.g., methanesulfonylamino, ethanesulfonylamino, benzenesulfonylamino), an amino group, a substituted amino group having from 1 to 20, preferably from 1 to 12, and more preferably from 1 to 8, carbon atoms (e.g., methylamino, dimethylamino, benzylamino, anilino, diphenylamino), an ammonium group having from 0 to 15, preferably from 3 to 10, and more preferably from 3 to 6, carbon atoms (e. g., trimethylammonium, triethylammonium), a hydrazino group having from 0 to 15, preferably from 1 to 10, and more preferably from 1 to 6, carbon atoms (e.g., trimethylhydrazino), a ureido group having from 1 to 15, preferably from 1 to 10, and more preferably from 1 to 6, carbon atoms (e.g., ureido, N,N-dimethylureido), an imido group having from 1 to 15, preferably from 1 to 10, and more preferably from 1 to 6, carbon atoms (e.g., succinimido), an alkylthio group having from 1 to 20, preferably from 1 to 12, and more preferably from 1 to 8, carbon atoms (e.g., methylthio, ethylthio, propylthio), an arylthio group having from 6 to 20, preferably from 6 to 12, and more preferably from 6 to 10, carbon atoms (e.g., phenylthio, p-methylphenylthio, p-chlorophenylthio, 2-pyridylthio, naphthylthio), an alkoxycarbonyl group having from 2 to 20, preferably from 2 to 12, and more preferably from 2 to 8, carbon atoms (e.g., methoxycarbonyl, ethoxycarbonyl, 2-benzyloxycarbonyl), an aryloxycarbonyl group having from 6 to 20, preferably from 6 to 12, and more preferably from 6 to 10, carbon atoms (e.g., phenoxycarbonyl), un unsubstituted alkyl group having from 1 to 18, preferably from 1 to 10, and more preferably from 1 to 5, carbon atoms (e.g., methyl, ethyl, propyl, butyl), a substituted alkyl group having from 1 to 18, preferably from 1 to 10, and more preferably from 1 to 5, carbon atoms (e.g., hydroxymethyl, trifluoromethyl, benzyl, carboxyethyl, ethoxycarbonylmethyl, acetylaminomethyl, herein an unsaturated hydrocarbon group having from 2 to 18, preferably from 3 to 10, and more preferably from 3 to 5, carbon atoms (e. g., vinyl, ethynyl, 1-cyclohexenyl, benzylidyne, benzylidene) is also included in the substituted alkyl group), an unsubstituted aryl group having from 6 to 20, preferably from 6 to 15, and more preferably from 6 to 10, carbon atoms (e.g., phenyl, naphthyl, p-carboxyphenyl, p-nitrophenyl, 3,5-dichlorophenyl, p-cyanophenyl, m-fluorophenyl, p-tolyl), and a substituted or unsubstituted heterocyclic group having from 1 to 20, preferably from 2 to 10, and more preferably from 4 to 6, carbon atoms (e. g., pyridyl, 5-methylpyridyl, thienyl, furyl, morpholino, tetrahydrofurfuryl). Further, V may take the structure condensed with an aromatic ring (e.g., benzene, naphthalene).

These above-described substituents may further be substituted with V. Preferred examples of such substituents are the above-described alkyl group, aryl group, alkoxyl group, halogen atom, aromatic condensed ring, sulfo group, carboxyl group, and hydroxyl group.

More preferred examples of the substituents V on Z1 and Z2 are an aryl group, a heterocyclic group, and an aromatic condensed ring, and particularly preferred is an aromatic condensed ring.

R1 and R2 each represents an alkyl group, an aryl group, or a heterocyclic group, specifically, e.g., an unsubstituted alkyl group having from 1 to 18, preferably from 1 to 7, and more preferably from 1 to 4, carbon atoms (e.g., methyl, ethyl, propyl, isopropyl, butyl, isobutyl, hexyl, octyl, dodecyl, octadecyl), a substituted alkyl group having from 1 to 18, preferably from 1 to 7, and more preferably from 1 to 4, carbon atoms (e.g., the alkyl group substituted with the substituent V described above can be exemplified, preferably an aralkyl group (e.g., benzyl, 2-phenylethyl), an unsaturated hydrocarbon group (e.g., allyl), a hydroxyalkyl group (e.g., 2-hydoxyethyl, 3-hydroxypropyl), a carboxyalkyl group (e.g., 2-carboxyethyl, 3-carboxypropyl, 4-carboxybutyl, carboxymethyl), an alkoxyalkyl group (e.g., 2-methoxyethyl, 2-(2 -methoxyethoxy) ethyl), an aryloxyalkyl group (e.g., 2-phenoxyethyl, 2-(1-naphthoxy)ethyl), an alkoxycarbonylalkyl group (e.g., ethoxycarbonylmethyl, 2-benzyloxycarbonylethyl), an aryloxycarbonylalkyl group (e.g., 3-phenoxycarbonylpropyl), an acyloxyalkyl group (e.g., 2-acetyloxyethyl), an acylalkyl group (e.g., 2-acetylethyl), a carbamoylalkyl group (e.g., 2-morpholinocarbonylethyl), a sulfamoylalkyl group (e.g., N,N-dimethylcarbamoylmethyl), a sulfoalkyl group (e.g., 2-sulfoethyl, 3-sulfopropyl, 3-sulfobutyl, 4-sulfobutyl, 2-(3-sulfopropoxy)ethyl, 2-hydroxy-3-sulfopropyl, 3-sulfopropoxyethoxyethyl), a sulfoalkenyl group, a sulfatoalkyl group (e.g., 2-sulfatoethyl, 3-sulfatopropyl, 4-sulfatobutyl), a heterocyclic ring-substituted alkyl group (e.g., 2-(pyrrolidin-2-one-1-yl) ethyl, tetrahydrofurfuryl), an alkylsulfonylcarbamoylmethyl group (e.g., methanesulfonyl-carbamoylmethyl)), an unsubstituted aryl group having from 6 to 20, preferably from 6 to 10, and more preferably from 6 to 8, carbon atoms (e.g., phenyl, 1-naphthyl), a substituted aryl having from 6 to 20, preferably from 6 to 10, and more preferably from 6 to 8, carbon atoms (e.g., the aryl group substituted with the substituent V described above can be exemplified, specifically, p-methoxyphenyl, p-methylphenyl, p-chlorophenyl), an unsubstituted heterocyclic group having from 1 to 20, preferably from 3 to 10, and more preferably from 4 to 8, carbon atoms (e.g., 2-furyl, 2-thienyl, 2-pyridyl, 3-pyrazolyl, 3-isooxazolyl, 3-isothiazolyl, 2-imidazolyl, 2-oxazolyl, 2-thiazolyl, 2-pyridazyl, 2-pyrimidyl, 3-pyrazyl, 2-(1,3,5-triazolyl), 3-(1,2,4-triazolyl), 5-tetrazolyl), and a substituted heterocyclic group having from 1 to 20, preferably from 3 to 10, and more preferably from 4 to 8, carbon atoms (e.g., the heterocyclic group substituted with the substituent V described above can be exemplified, specifically, 5-methyl-2-thienyl, 4-methoxy-2-pyridyl) can be exemplified.

In formula (I), preferably at least one of R1 or R2 is a group containing at least one aromatic ring, and the compound represented by formula (I) forms an inner salt and does not have electric charge. Accordingly, the compound represented by formula (I) must have at least one anionic group in the molecule. Such an anionic group is preferably contained in either R1 or R2. As the aromatic ring contained in R1 or R2, an aromatic hydrocarbon ring, a condensed polycyclic aromatic hydrocarbon ring, and an aromatic heterocyclic ring are exemplified, and these rings may further be substituted with the above-described substituent V or may form a condensed ring. As the aromatic ring contained in R1 or R2, benzene, naphthalene, pyrrole, furan, thiophene, pyridine, and quinoline are exemplified.

R1 and R2 each preferably represents, as the alkyl group substituted with an aryl group, an aralkyl group (e.g., benzyl, 2-phenylethyl, naphthylmethyl, 2-(4-biphenyl)ethyl), an aryloxyalkyl group (e.g., 2-phenoxyethyl, 2-(1-naphthoxy) ethyl, 2-(4-biphenyloxy)ethyl, 2-(o-, m-, p-halophenoxy) ethyl, 2-(o-, m-, p-methoxyphenoxy)ethyl), an aryloxycarbonylalkyl group (e.g., 3-phenoxycarbonylpropyl, 2-(1-naphthoxycarbonyl)ethyl), an aralkyl group substituted with a sulfo group, a phosphoric acid group and/or a carboxyl group (e.g., 2-sulfobenzyl, 4-sulfobenzyl, 4-sulfophenethyl, 3-phenyl-3-sulfopropyl, 3-phenyl-2-sulfopropyl, 4,4-diphenyl-3-sulfobutyl, 2-(4'-sulfo-4-biphenyl)ethyl, 4-phosphobenzyl), an aryloxcarbonylalkyl group substituted with a sulfo group, a phosphoric acid group and/or a carboxyl group (e.g., 3-sulfophenoxycarbonylpropyl), an aryloxyalkyl group substituted with a sulfo group, a phosphoric acid group and/or a carboxyl group (e.g., 2-(4-sulfophenoxy)ethyl, 2-(2-phosphophenoxy)ethyl, 4,4-diphenoxy-3-sulfobutyl); as the alkyl group substituted with a heterocyclic group, e.g., 2-(pyrrolidin-2-one-1-yl)ethyl, 2-(2-pyridyl)ethyl, 2-(4-pyridyl)ethyl, 2-(2-furyl)ethyl, 2-(2-thienyl)ethyl, 2-(2-pyridylmethoxy)ethyl, 3-(2-pyridyl)-3-sulfopropyl, 3-(2-furyl)-3-sulfopropyl, 2-(2-thienyl)-2-sulfopropyl; as the aryl group, 4-methoxyphenyl, phenyl, naphthyl, biphenyl, or the aryl group substituted with a sulfo group, a phosphoric acid group and/or a carboxyl group (e.g., 4-sulfophenyl, 4-sulfonaphthyl); as the heterocyclic group, 2-thienyl, 4-chloro-2-thienyl, 2-pyridyl, 3-pyrazolyl, or the heterocyclic group substituted with a sulfo group, a phosphoric acid group, or a carboxyl group (e.g., 4-sulfo-2-thienyl, 4-sulfo-2-pyridyl).

R1 and R2 each more preferably represents the above-described substituted or unsubstituted aryl group, the alkyl group substituted with an aryl group or a heterocyclic group, the aralkyl group substituted with a sulfo group, a phosphoric acid group, or a carboxyl group, or the aryloxyalkyl group substituted with a sulfo group, a phosphoric acid group, or a carboxyl group.

L1, L2, L3, L4, L5, L6 and L7 each represents a methine group. The methine group represented by L1, L2, L3, L4, L5, L6 and L7 may have a substituent, and examples of the substituents include a substituted or unsubstituted alkyl group having from 1 to 15, preferably from 1 to 10, and more preferably from 1 to 5, carbon atoms (e.g., methyl, ethyl, 2-carboxyethyl), a substituted or unsubstituted aryl group having from 6 to 20, preferably from 6 to 15, and more preferably from 6 to 10, carbon atoms (e.g., phenyl, o-carboxyphenyl), a substituted or unsubstituted heterocyclic group having from 3 to 20, preferably from 4 to 15, and more preferably from 6 to 10, carbon atoms (e.g., N,N-dimethyl thiobarbituric acid group), a halogen atom (e.g., chlorine, bromine, iodine, fluorine), an alkoxyl group having from 1 to 15, preferably from 1 to 10, and more preferably from 1 to 5, carbon atoms (e.g., methoxy, ethoxy), an amino group having from 0 to 15, preferably from 2 to 10, and more preferably from 4 to 10, carbon atoms (e.g., methylamino, N,N-dimethylamino, N-methyl-N-phenylamino, N-methylpiperazino), an alkylthio group having from 1 to 15, preferably from 1 to 10, and more preferably from 1 to 5, carbon atoms (e.g., methylthio, ethylthio), and an arylthio group having from 6 to 20, preferably from 6 to 12, and more preferably from 6 to 10, carbon atoms (e.g., phenylthio, p-methylphenylthio). L1, L2, L3, L4, L5, L6 and L7 each may form a ring with other methine group, or may form a ring with Z1 to Z2.

n1 represents 0, 1, 2, 3 or 4, preferably 0, 1, 2 or 3, more preferably 0, 1 or 2, and most preferably 0 or 1. When n1 represents 2 or more, a methine group is repeated but the plurality of methine groups is not always the same.

p1 and p2 each represents 0 or 1, preferably 0.

In the present invention, when the dye represented by formula (I) is adsorbed onto a silver halide grain, it is preferred for the dye represented by formula (I) to form a J-association body (i.e., J-aggregate) for obtaining an absorption band and spectral sensitivity in a desired wavelength region.

Specific examples of the compounds represented by formula (I) for use in the particularly preferred techniques as described above in the explanation of the embodiments of the present invention are shown below. It should not be construed as the present invention is limited thereto.

Specific examples of the compounds represented by formula (I).

S-1

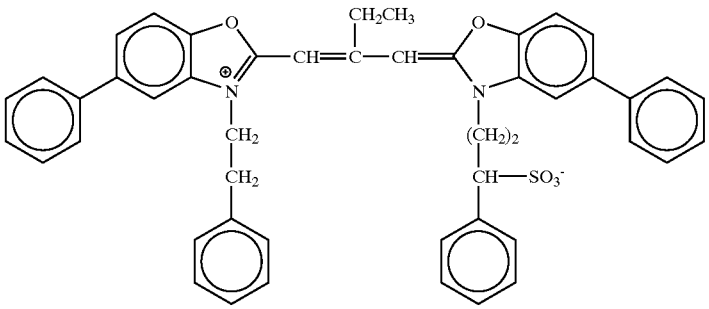

S-2

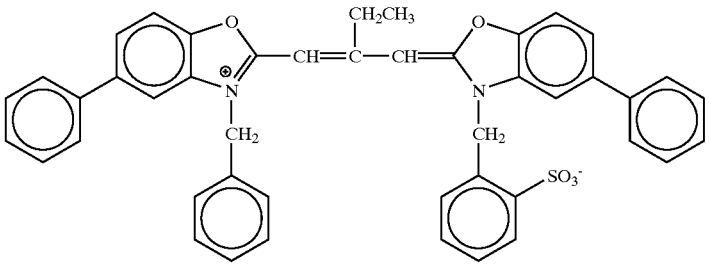

S-3

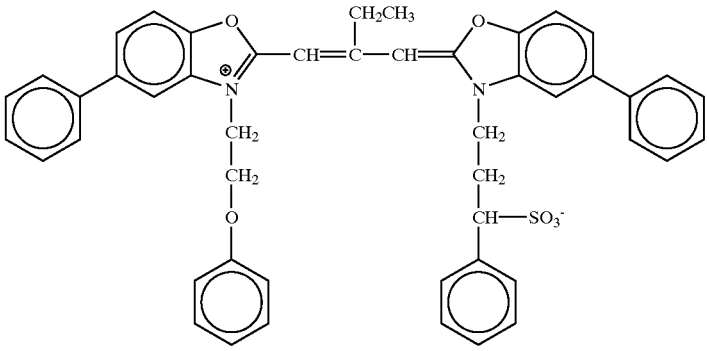

-continued
S-4
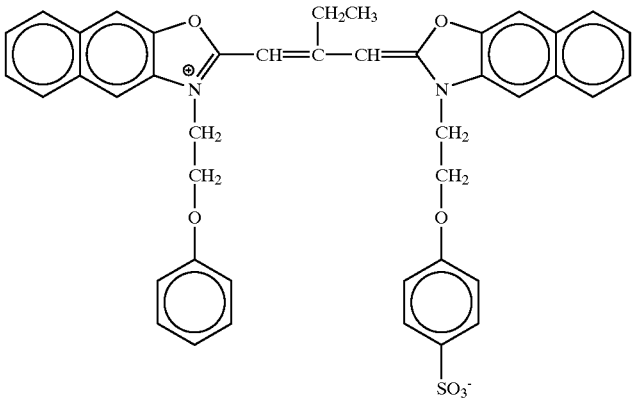
S-5
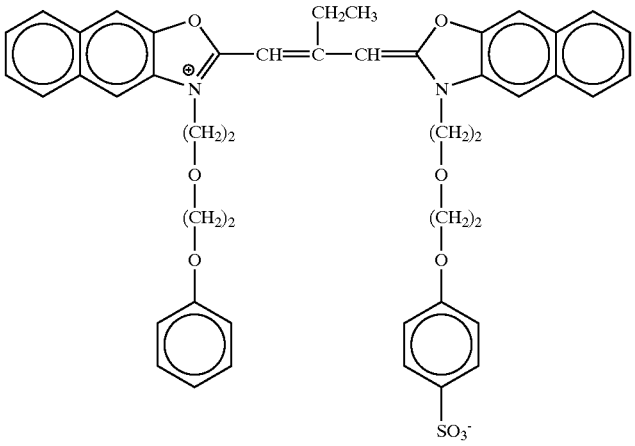
S-6
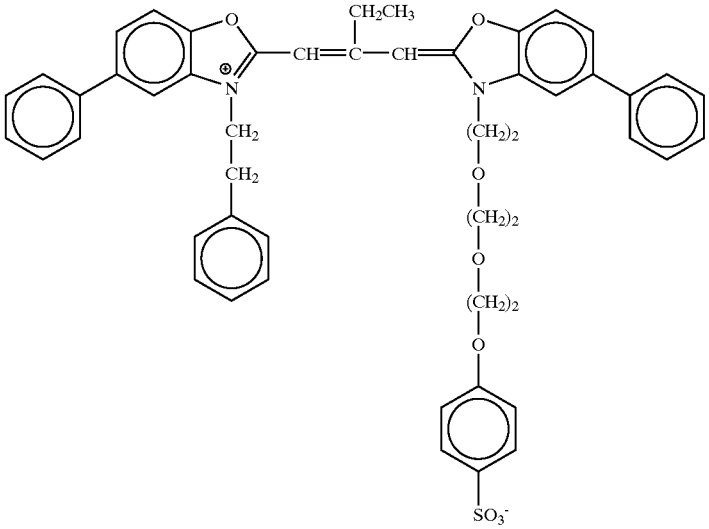

-continued
S-7
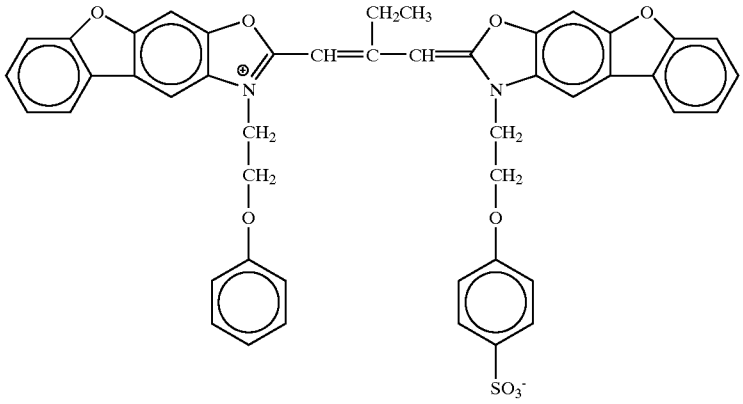
S-8
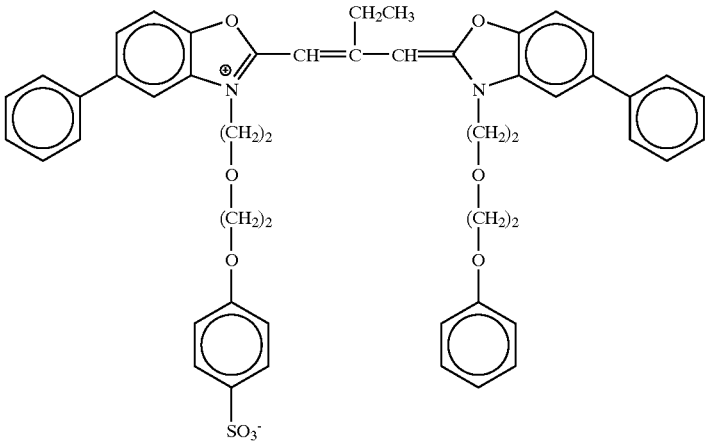
S-9
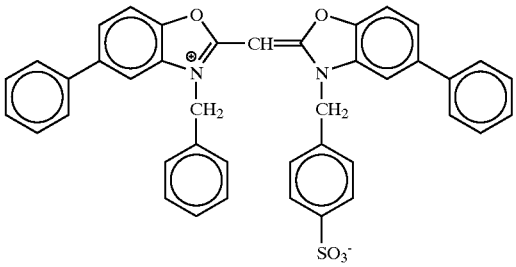
S-10
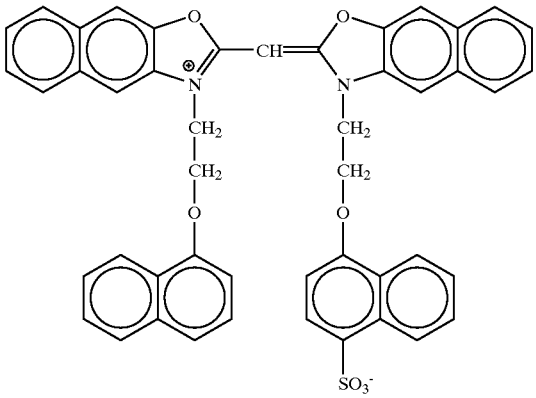
S-11
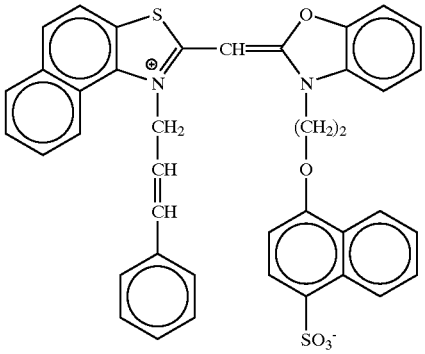
S-12
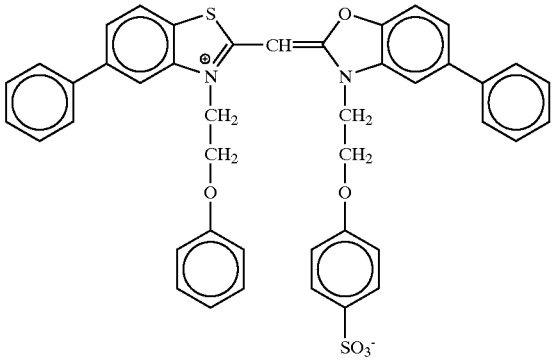

-continued
S-13
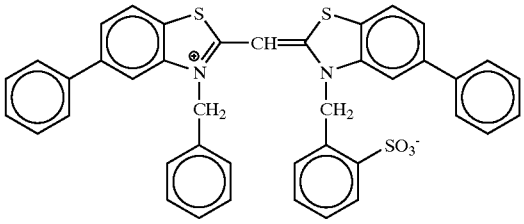
S-14
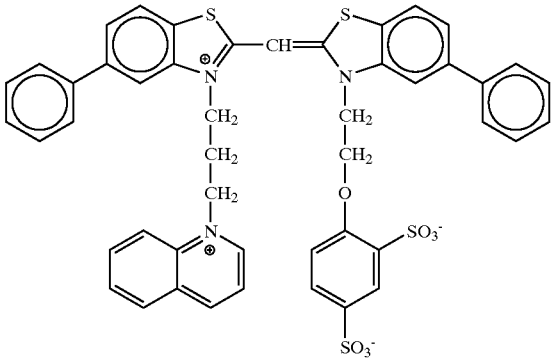
S-15
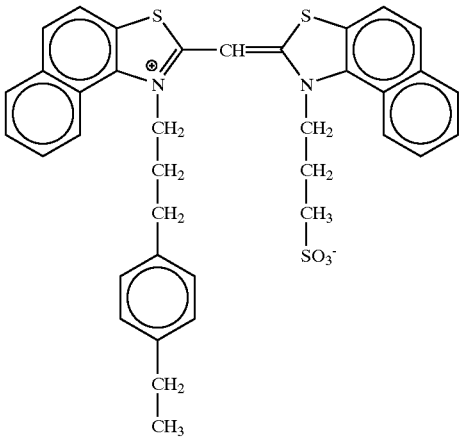
S-16
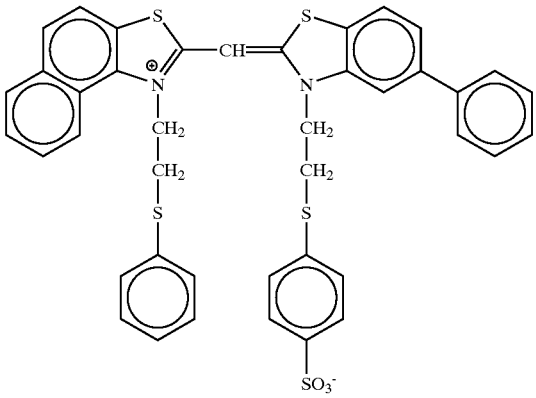
S-17
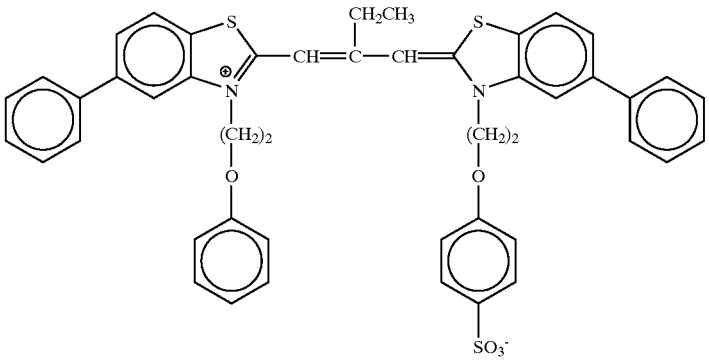
S-18
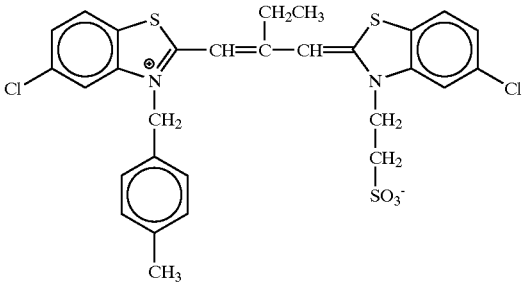
S-19
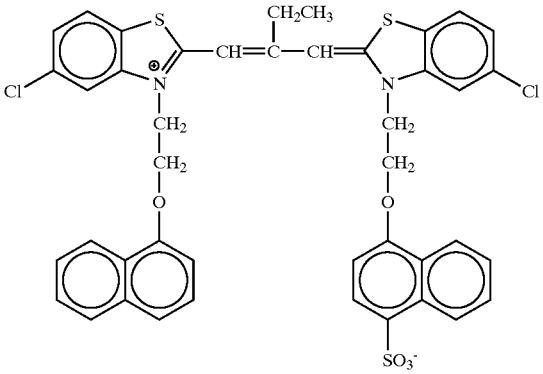

-continued
S-20
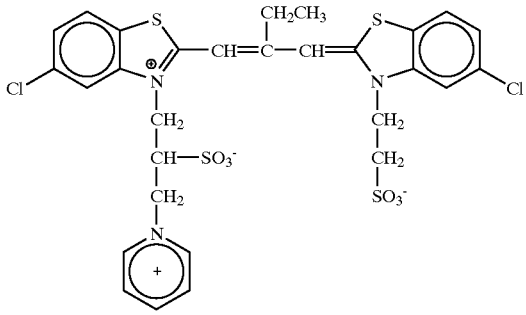
S-21
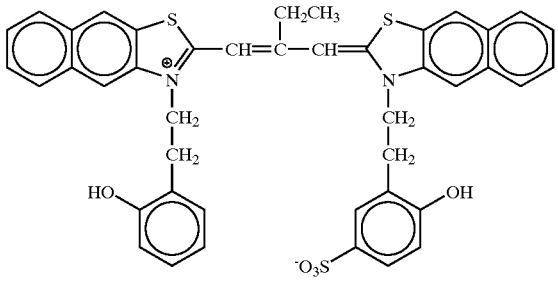
S-22
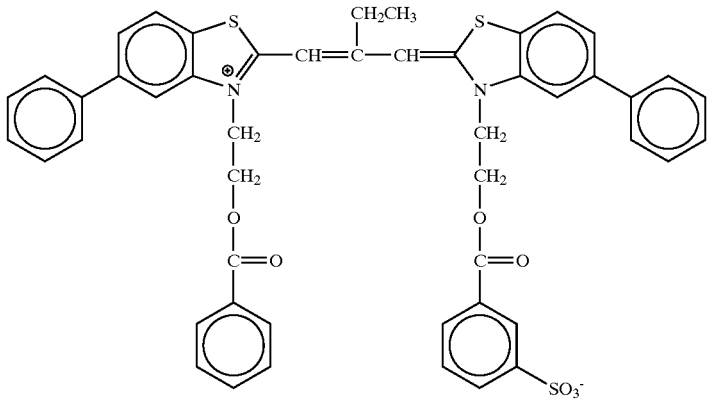
S-23
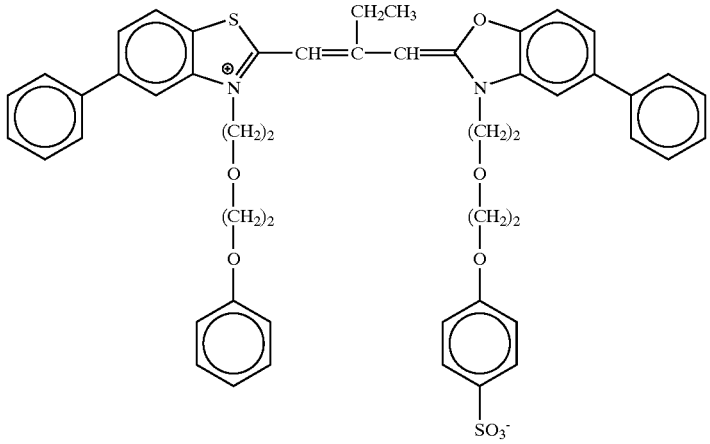
S-24
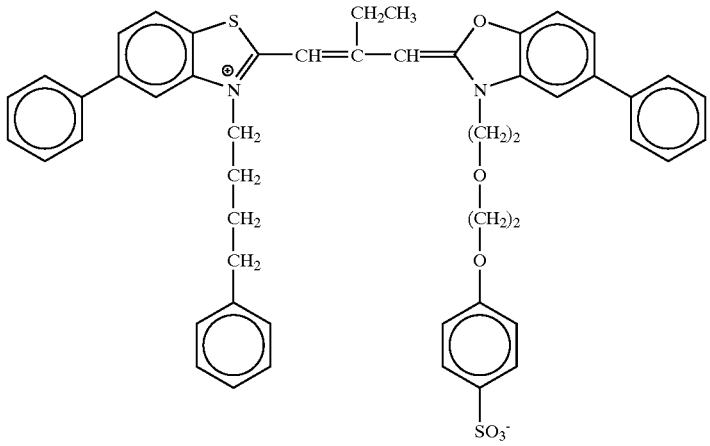

-continued
S-25
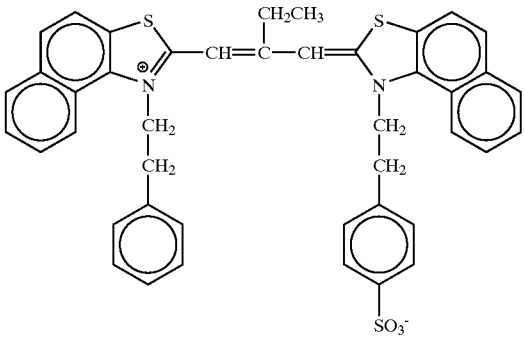
S-26
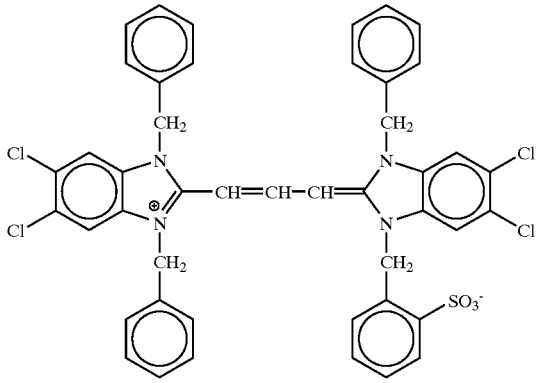
S-27
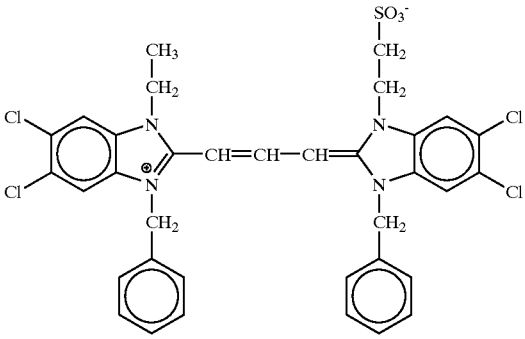
S-28
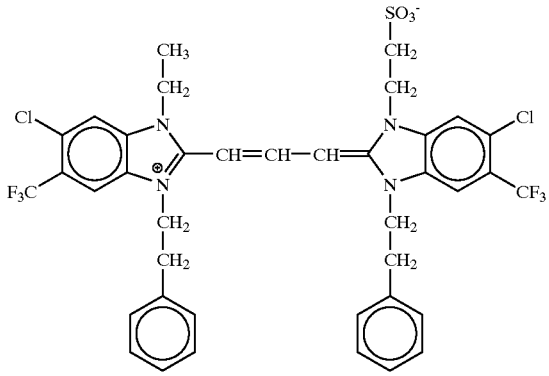
S-29
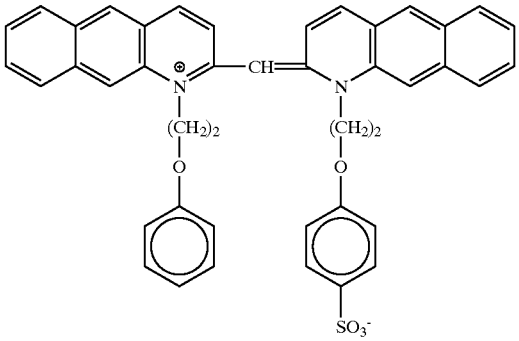
S-30
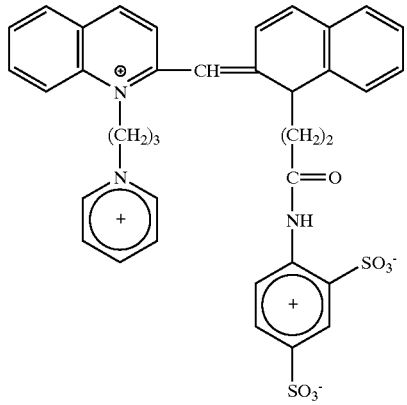
S-31
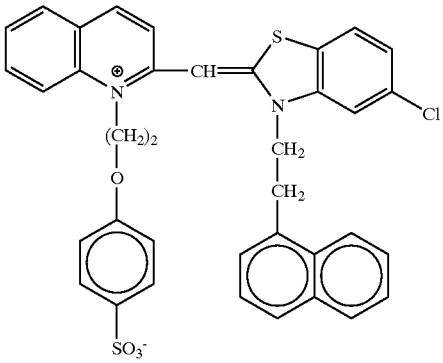

-continued
S-32
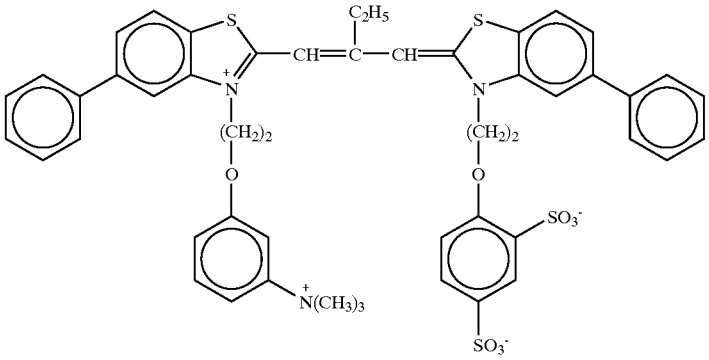
S-33
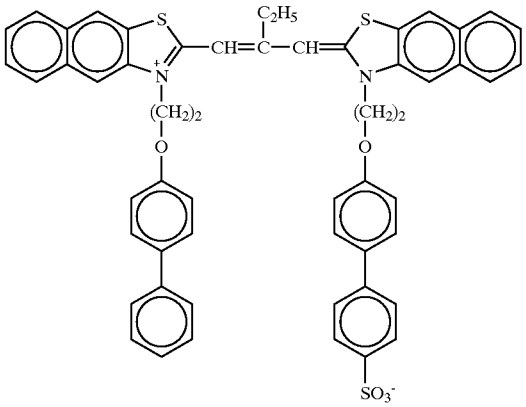
S-34
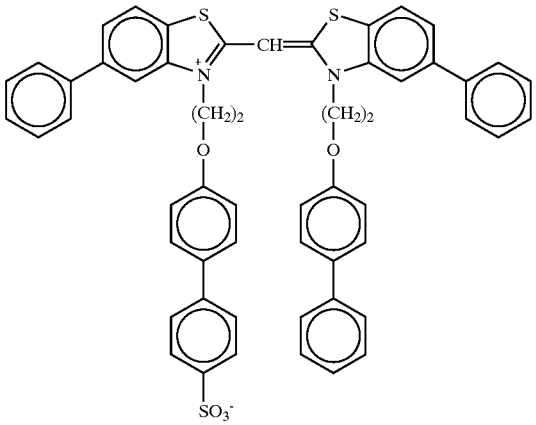
S-35
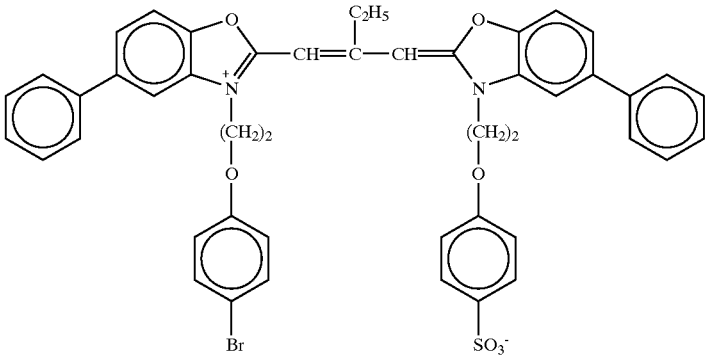
S-36
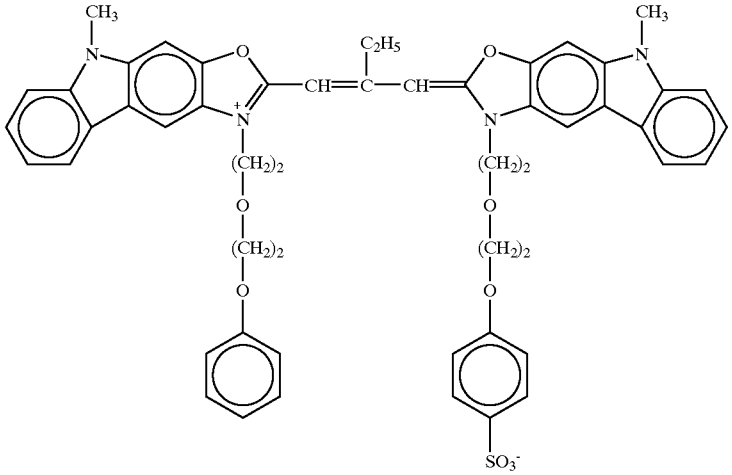

-continued
S-37
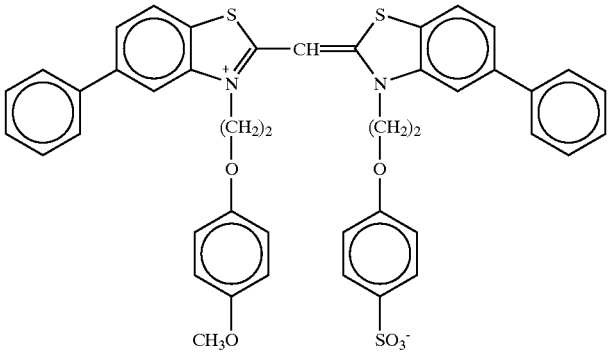
S-38
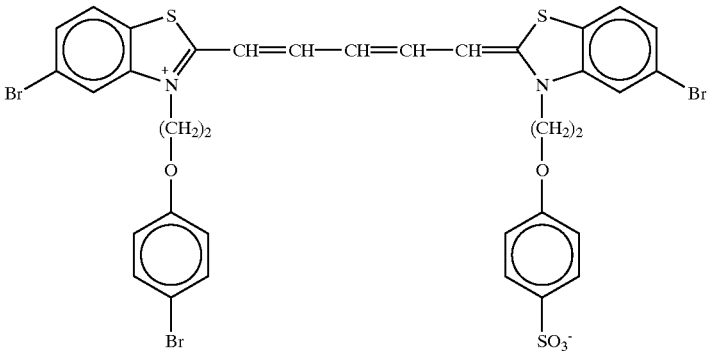
S-39
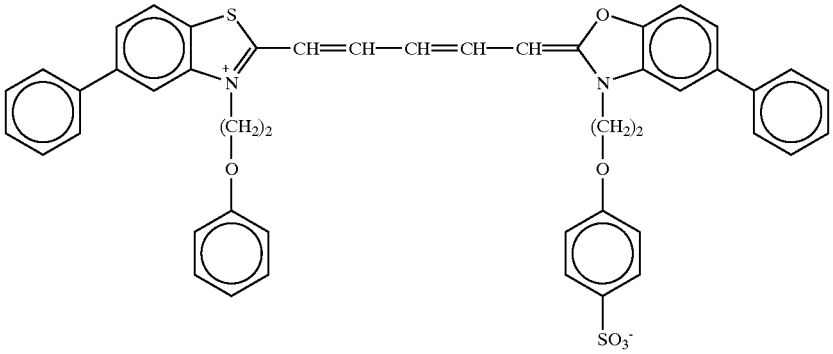
S-40
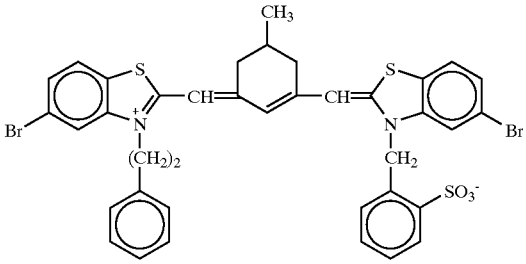
S-41
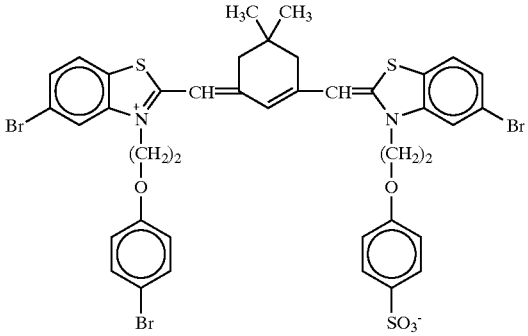

-continued
S-42
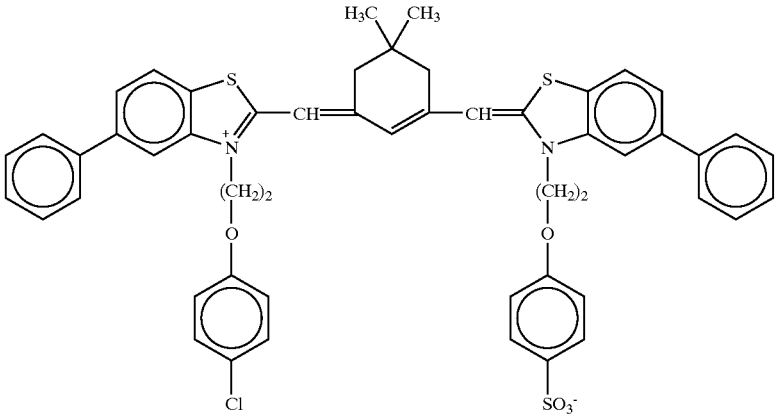
S-43
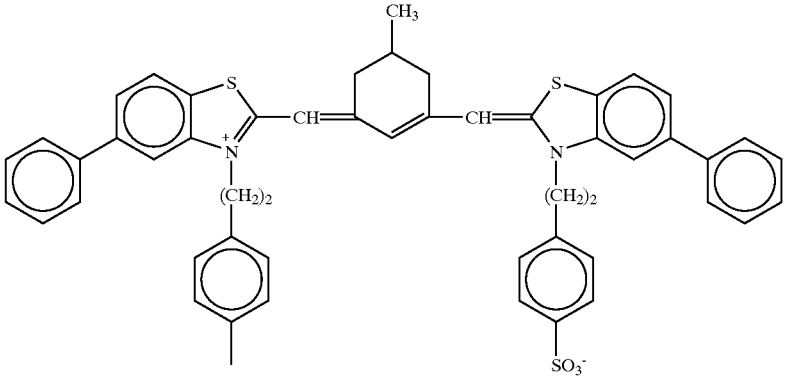
S-44
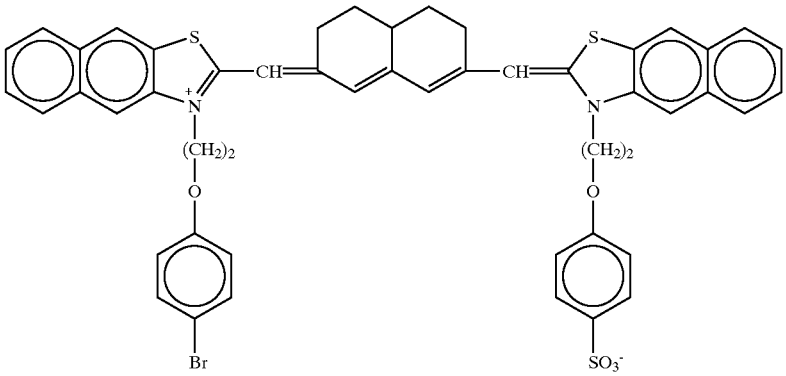

-continued
S-45
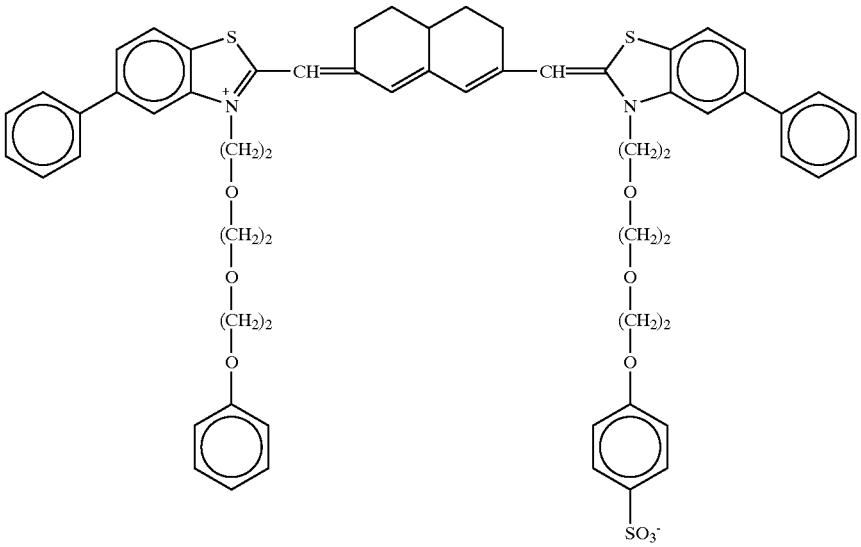
S-46
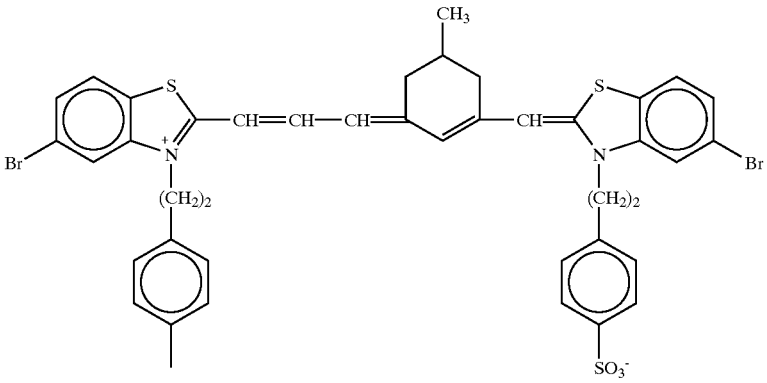
S-47
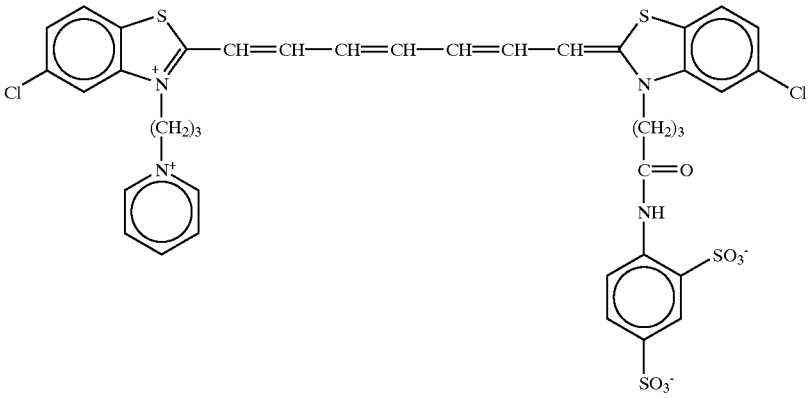

-continued
S-48
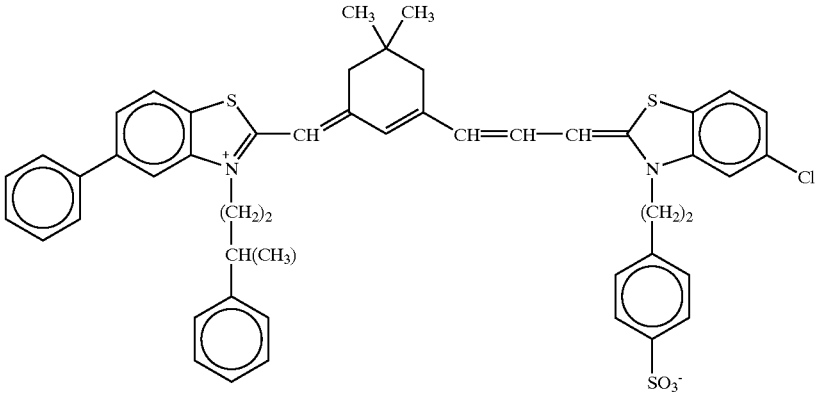
S-49
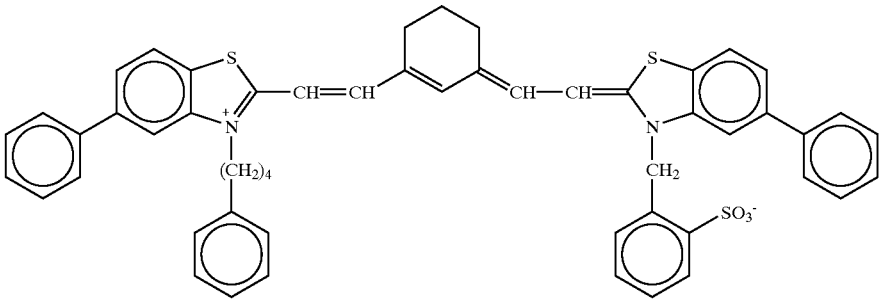
S-50
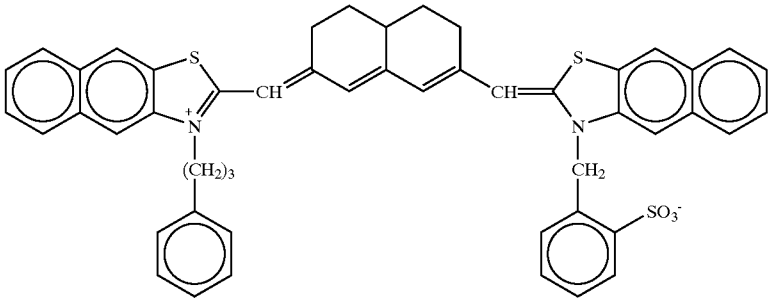
S-51
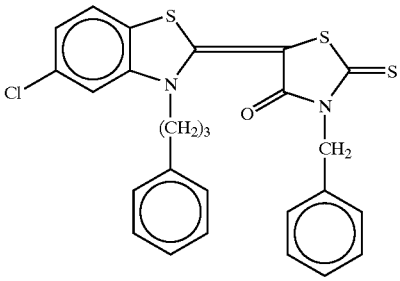
S-52
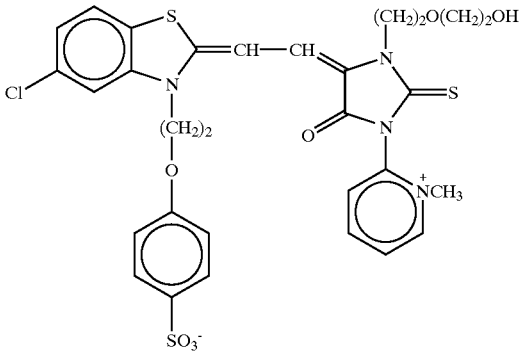

-continued

S-53

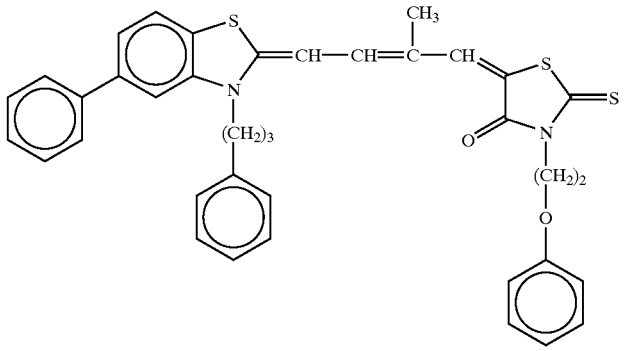

S-54

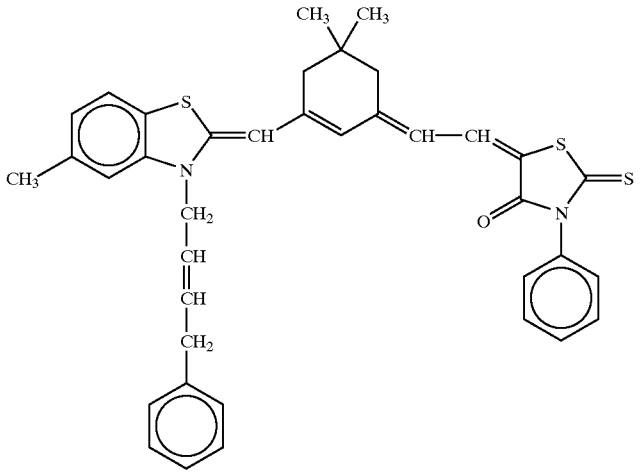

The compound represented by formula (I) according to the present invention can be synthesized by referring to the methods described in F. M. Harmer, *Heterocyclic Compounds—Cyanine Dyes and Related Compounds,* John Wiley & Sons, New York, London (1964), D. M. Sturmer, *Heterocyclic Compounds—Special Topics in Heterocyclic Chemistry,* Chap. 18, Clause 14, pp. 482 to 515, John Wiley & Sons, New York, London (1977), and *Rodd's Chemistry of Carbon Compounds,* 2nd Ed., Vol. IV, Part B, Chap. 15, pp. 369 to 422, Elsevier Science Publishing Company Inc., New York (1977), etc.

For the inclusion of the compound represented by formula (I) in the silver halide emulsion of the present invention, the compound may be directly dispersed in the emulsion, or may be dissolved in water, a single or mixed solvent of methanol, ethanol, propanol, acetone, methyl cellosolve, 2,2,3,3-tetrafluoropropanol, 2,2,2-trifluoroethanol, 3-methoxy-1-propanol, 3-methoxy-1-butanol, 1-methoxy-2-propanol, acetonitrile, tetrahydrofuran, N,N-dimethylformamide, etc., and then added to the emulsion.

In addition, various methods can be used for the inclusion of the sensitizing dyes in the emulsion, for example, a method in which dyes are dissolved in a volatile organic solvent, the solution is dispersed in water or hydrophilic colloid and this dispersion is added to the emulsion as described in U.S. Pat. No. 3,469,987, a method in which a water-insoluble dye is dispersed in a water-soluble solvent without being dissolved and this dispersion is added to the emulsion as described in JP-B-46-24185 (the term "JP-B" as used herein means an "examined Japanese patent publication"), a method in which a dye is dissolved in acid and the solution is added to the emulsion, or a dye is added to the emulsion as an aqueous solution coexisting with an acid or a base as described in JP-B-44-23389, JP-B-44-27555 and JP-B-57-22091, a method in which a dye is added to the emulsion as an aqueous solution or colloidal dispersion coexisting with a surfactant as described in U.S. Pat. Nos. 3,822,135 and 4,006,025, a method in which a dye is directly dispersed in a hydrophilic colloid and the dispersion is added to the emulsion as described in JP-A-53-102733 and JP-A-58-105141, or a method in which a dye is dissolved using a compound capable of red-shifting and the solution is added to the emulsion as described in JP-A-51-74624 can be used.

Further, ultrasonic waves can be used for dissolution.

A dye may be added dividedly or may be added at one time. When a dye is added dividedly, the fluorescent yield of the dye added later in a gelatin dry film is preferably 0.5 or more, more preferably 0.8 or more.

It is also preferred that the reduction potential of the dye added later is equal to or less than that of the dye added first, more preferably the reduction potential of the dye added later is less by 0.03 V or more than that of the dye added first. Further, it is preferred that the oxidation potential of the dye added later is less by 0.01 V or more than that of the dye added first, more preferably by 0.03 V or more.

A Dye may be added at any time of the emulsion preparation. The addition temperature of a dye may be any degree but the emulsion temperature at the time of dye addition is preferably from 10° C. to 75° C., and particularly preferably from 30° C. to 65° C.

The emulsion for use in the present invention may not be chemically sensitized but is preferably chemically sensitized. The total addition amount of a dye may be added before chemical sensitization or after chemical sensitization, but optimal chemical sensitization can be effected by performing chemical sensitization after a part of the dye is added and the remaining part of the dye is added after the chemical sensitization.

The silver halide emulsion for use in the silver halide photographic material according to the present invention is not particularly restricted and any of silver chloride, silver chlorobromide, silver bromide, silver iodochloride or silver iodobromide can be used but is preferably an emulsion containing bromide ion or an iodide ion. Silver halide grains in a photographic emulsion may have a regular crystal form or an irregular crystal form. Grains of a form having a plurality of twin planes may be used, and hexagonal tabular grains and triangular tabular grains having two or three parallel twin planes are preferably used. Tabular grains of monodispersed grain size distribution (variation coefficient: 10 to 20%) are more preferred. Monodispersed hexagonal tabular grains are disclosed in JP-A-63-151618, JP-A-2-838 and EP 514742.

The variation coefficient of grain thickness is preferably 20% or less, particularly preferably from 5 to 15%.

With respect to tabular grains, grains having {100} main planes and {111} main planes are known. Tabular grains having {100} main planes are disclosed in U.S. Pat. No. 4,063,951 and JP-A-5-281640 concerning silver bromide, and in EP-A-0534395 and U.S. Pat. No. 5,264,337 concerning silver chloride. Tabular grains having {111} main planes have various forms having one or more twin planes and are disclosed in U.S. Pat. Nos. 4,399,215, 4,983,508, 5,183,732, JP-A-3-137632 and JP-A-3-116113 concerning silver chloride. The present invention is preferably applicable to tabular grains having {100} main planes and {111} main planes. The tabular grains have an aspect ratio (equivalent-circle diameter/grain thickness) of from 2 to 100, preferably from 3 to 50, and particularly preferably from 5 to 30, an equivalent-circle diameter of from 0.2 to 5.0 μm, preferably from 0.5 to 3.0 μm, and particularly preferably from 0.6 to 2. 0 μm, and a grain thickness of preferably from 0.02 to 0.3 μm, particularly preferably from 0.03 to 0.2 μm.

Silver halide grains may have dislocation lines in the molecule. The method for introducing dislocation lines with controlling the dislocation into silver halide grains is disclosed in JP-A-63-220238. By the introduction of dislocation lines, the increase of sensitivity, the improvement of storage stability, the improvement of latent image stability, the reduction of stress marks can be obtained. Dislocation lines are mainly introduced into the edge part of the grain. The tabular grains having introduced dislocation lines at the central parts are disclosed in U.S. Pat. No. 5,238,796. The effects of the present invention are exhibited when 50% or more in number of the silver halide grains have ten or more dislocation lines per one grain.

A silver halide solvent can be used for accelerating the growth of grains during the crystal forming stage or for effectively performing chemical sensitization during the grain forming stage and/or the chemical sensitizing stage. As preferred silver halide solvents, water-soluble thiocyanate, ammonia, thioethers and thioureas can be used. Examples of silver halide solvents include thiocyanates (e.g., disclosed in U.S. Pat. Nos. 2,222,264, 2,448,534, 3,320,069), ammonia, thioether compounds (U.S. Pat. Nos. 3,271,157, 3,574,628, 3,704,130, 4,297,439, 4,276,347), thione compounds (JP-A-53-144319, JP-A-53-82408, JP-A-55-77737), amine compounds (JP-A-54-100717), thiourea derivatives (JP-A-55-2982), imidazoles (JP-A-54-100717), and substituted mercaptotetrazoles (JP-A-57-202531).

The producing method of the silver halide emulsion is not particularly restricted. That is, any process, such as an acid process, a neutral process, and an ammoniacal process, can be used. A single jet method, a double jet method, and a combination of them are known as methods for reacting a soluble silver salt with a soluble halide, and any of these methods can be used. It is preferred to grow grains fast within the range not exceeding the degree of critical oversaturation using the method of changing the addition rates of silver nitrate and an alkali halide aqueous solution corresponding to the speed of grain growth as described in British Patent 1,535,016, JP-B-48-36890 and JP-B-52-16364, or the method of changing the concentration of the aqueous solution as described in U.S. Pat. No. 4,242,445 and JP-A-55-158124.

In place of adding a silver salt solution and a halide solution to a reaction vessel, a method of adding previously prepared fine grains to a reaction vessel to cause nucleation and/or grain growth to thereby obtain silver halide grains is also preferably used. According to this method, the distribution of halogen ion in the emulsion grain crystals can be made completely uniform and preferred photographic characteristics can be obtained. Emulsion grains having various structures can be used in the present invention. Grains of so-called core/shell type double structure comprising a core part and a shell part, grains of triple structure (JP-A-60-222844), and grains of multilayer structure may be used. When grains having structures in the interior of the grains are prepared, not only the above-described wrapping structures but grains having conjugation structures can also be produced. Examples of such structures are described in JP-A-58-108526, JP-A-59-16254, JP-A-59-133540, JP-B-58-24772 and EP-A-19929,0. In the present invention, grains having core/shell type double structure are most preferably used.

In cases of silver iodobromide grains having these structures, e.g., in core/shell type grains, the grains comprising high silver iodide content core part and low silver iodide content shell part, and the grains comprising low silver iodide content core part and high silver iodide content shell part may be used. The silver halide emulsion for use in the present invention is preferably a surface latent image type emulsion. However, as disclosed in JP-A-59-133542, internal latent image type emulsions may also be used by selecting a developing solution or developing conditions. In addition, shallow internal latent image type emulsions covered with a thin shell can be used according to purposes.

The silver iodobromide tabular grain emulsions preferably used in the present invention can be produced with referring to U.S. Pat. Nos. 4,439,520, 4,434,226, 4,433,048, 4,414,310, and 5,334,495.

Concerning ultra-thin tabular grain emulsions having a thickness of 0.1 μm or less, U.S. Pat. Nos. 5,460,928, 5,411,853 and 5,418,125 can be referred to.

When the present invention is applied to high silver chloride tabular emulsions, with respect to the emulsions preferably used therefor, EP 723187, EP 619517, EP 534395 and EP 584644 can be referred to.

A silver halide emulsion is in general chemically sensitized before use. As chemical sensitization, chalcogen sensitization (sulfur sensitization, selenium sensitization, tellurium sensitization), noble metal sensitization (gold sensitization) and reduction sensitization are used alone or in combination. In the present invention, sulfur sensitization and the combination of gold sensitization and sulfur sensitization are preferably used as chemical sensitization but selenium sensitization and tellurium sensitization are also preferably used. In sulfur sensitization, labile sulfur compounds are used as a sensitizer. Examples of sulfur sensitizers include thiosulfates (e.g., sodium thiosulfate, p-toluenethiosulfonate), thioureas (e.g., diphenylthiourea, triethylthiourea, N-ethyl-N'-(4-methyl-2-thiazolyl)thiourea, carboxy-methyltrimethylthiourea), thioamides (e.g., thioacetamide, N-phenylthioacetamide), rhodanines (e.g., rhodanine, N-ethylrhodanine, 5-benzylidenerhodanine, 5-benzylidene-N-ethylrhodanine, diethylrhodanine), phosphine sulfides (e.g., trimethylphosphine sulfide), thiohydantoins, 4-oxo-oxazolidine-2-thiones, dipolysulfides (e.g., dimorpholine disulfide, cystine, hexathiocanethione), mercapto compounds (e.g., cysteine), polythionate, and elemental sulfur. Active gelatins can also be used as a sulfur sensitizer.

In selenium sensitization, labile selenium compounds are used as a sensitizer. Labile selenium compounds are disclosed in JP-B-43-13489, JP-B-44-15748, JP-A-4-25832, JP-A-4-109240, JP-A-4-271341, and JP- A-5-40324. Examples of selenium sensitizers include colloidal metal selenium, selenoureas (e.g., N,N-dimethylselenourea, trifluoromethylcarbonyl-trimethylselenourea, acetyl-trimethylselenourea), selenoamides (e.g., selenoacetamide, N,N-diethylphenylselenoamide), phosphineselenides (e.g., triphenylphosphineselenide, pentafluorophenyltriphenylphosphineselenide), selenophosphates (e.g., tri-p-tolylselenophosphate, tri-n-butylselenophosphate), seleno ketones (e.g., selenobenzophenone), isoselenocyanates, selenocarboxylic acids, seleno esters, and diacylselenides. In addition, comparatively stable selenium compounds such as selenious acid, potassium selenocyanide, selenazoles and selenides (disclosed in JP-B-46-4553 and JP-B-52-34492) can also be used as a selenium sensitizer.

Labile tellurium compounds are used as a tellurium sensitizer in tellurium sensitization. Labile tellurium compounds are disclosed in Canadian Patent 800,958, British Patents 1,295,462, 1,396,696, JP-A-4-204640, JP-A-4-271341, JP-A-4-333043, and JP-A-5-303157. Examples of tellurium sensitizers include telluroureas (e.g., tetramethyltellurourea, N,N'-dimethylethylenetellurourea, N,N'-diphenylethylenetellurourea), phosphinetellurides (e.g., butyldiisopropylphosphinetelluride, tributylphosphinetelluride, tributoxyphosphinetelluride, ethoxydiphenylphosphinetelluride), diacyl(di)tellurides (e.g., bis(diphenylcarbamoyl)ditelluride, bis(N-phenyl-N-methylcarbamoyl)-ditelluride, bis(N-phenyl-N-methylcarbamoyl)telluride, bis-(ethoxycarbonyl)telluride), isotellurocyanatos (e.g., allylisotellurocyanato), telluro ketones (e.g., telluroacetone, telluroacetophenone), telluroamides (telluroacetamide, N,N-dimethyltellurobenzamide), tellurohydrazides, (e.g., N,N',N'-trimethyltellurobenzhydrazide), telluro esters (e.g., t-butyl-t-hexyltelluro ester), colloidal tellurium, (di)tellurides, and other tellurium compounds (e.g., potassium telluride, sodium telluropentathionate).

In noble metal sensitization, noble metal salts of gold, platinum, palladium, and iridium are used as a sensitizer. Noble metal salts are described in P. Glafkides, *Chimie et Physique Photographique,* 5th Ed., Paul Montel (1987) and *Research Disclosure,* Vol. 307, No. 307105. Gold sensitization is particularly preferred in the present invention. Examples of gold sensitizers include chloroauric acid, potassium chloroaurate, potassium aurithiocyanate, gold sulfide, and gold selenide, as well as gold compounds disclosed in U.S. Pat. Nos. 2,642,361, 5,049,484 and 5,049,485.

As one mode of gold sensitization, it is also preferred to use gold complexes as disclosed in U.S. Pat. Nos. 5,700,631, 5,759,761, 5,620,841, JP-A-3-266828, JP-A-4-67032, and JP-A-8-69074.

In the present invention, reduction sensitization can be used in combination.

Examples of reducing compounds include aminoiminomethanesulfinic acid (thiourea dioxide), borane compounds (e.g., dimethylamineborane), hydrazine compounds (e.g., hydrazine, p-tolylhydrazine), polyamine compounds (e.g., diethylenetriamine, triethylenetetramine), stannous chloride, silane compounds, reductones (e.g., ascorbic acid), sulfite, aldehyde compounds, and hydrogen gas. Reduction sensitization can be effected in the atmosphere of high pH and excessive silver ion (so-called silver ripening).

Chemical sensitization may be performed in combination of two or more. A combination of chalcogen sensitization with gold sensitization is particularly preferred. Reduction sensitization is preferably conducted during silver halide grain formation. The use amount of a sensitizer is in general determined according to the kind of silver halide grains to be used and the conditions of chemical sensitization. The use amount of a chalcogen sensitizer is generally from $10^{-8}$ to $10^{-2}$ mol, preferably from $10^{-7}$ to $5\times10^{-3}$ mol, per mol of the silver halide. The use amount of a noble metal sensitizer is preferably from $10^{-7}$ to $10^{-2}$ mol per mol of the silver halide. The conditions of chemical sensitization are not particularly limited. pAg is in general from 6 to 11, preferably from 7 to 10, pH is preferably from 4 to 10, and temperature is preferably from 40 to 95° C., and more preferably from 45 to 85° C.

The layer constitution of a silver halide photographic material is not particularly limited However, a color photographic material comprises a multilayer structure, as blue, green and red light are recorded separately. Each silver halide emulsion layer may consist of two layers of a high sensitivity layer and a low sensitivity layer. Examples of practical layer constitutions (1) to (6) are shown below.

(1) BH/BL/GH/GL/RH/RL/S
(2) BH/BM/BL/GH/GM/GL/RH/RM/RL/S
(3) BH/BL/GH/RH/GL/RL/S
(4) BH/GH/RH/BL/GL/RL/S
(5) BH/BL/CL/GH/GL/RH/RL/S
(6) BH/BL/GH/GL/CL/RH/RL/S

B represents a blue-sensitive layer, G represents a green-sensitive layer, R represents a red-sensitive layer, H represents the highest sensitivity layer, M represents a middle sensitivity layer, L represents a low sensitivity layer, S represents a support, and CL represents an interlayer effect imparting layer. Light-insensitive layers such as a protective layer, a filter layer, an interlayer, an antihalation layer, and a subbing layer are omitted. The arrangement of a high sensitivity layer and a low sensitivity layer having the same color sensitivity may be reversed. With respect to (3), U.S. Pat. No. 4,184,876 can be referred to, as to (4), in *Researcy Disclosure,* Vol. 225, No. 22534, JP-A-59-177551 and JP-A-59-177552, and as to (5) and (6), JP-A-61-34541 can be referred to, respectively. Preferred layer constitutions are (1), (2) and (4). Silver halide photographic material according to the present invention can also be applied to, besides color photographic materials, photographic materials for X-ray, black-and-white photographic materials for photographing, photographic materials for plate-making, and photographic paper.

With respect to various additives for use in silver halide emulsions (e.g., binders, chemical sensitizers, spectral sensitizers, stabilizers, gelatin, gelatin hardening agents, surfactants, antistatic agents, polymer latexes, matting agents, color couplers, ultraviolet absorbers, discoloration inhibitors, and dyes), supports of photographic materials and processing methods of photographic materials (e.g., coating methods, exposing methods, development processing methods), descriptions in *Research Disclosure,* Vol. 176, No. 17643 (*RD* 17643), ibid., Vol. 187, No. 18716 (*RD* 18716) and ibid. Vol. 225, No. 22534 (*RD* 22534) can be referred to. These descriptions in *Research Disclosures* are listed in the following table.

| Type of Additives | RD 17643 | RD 18716 | RD 22534 |
|---|---|---|---|
| 1. Chemical Sensitizers | page 23 | page 648, right column | page 24 |
| 2. Sensitivity Increasing Agents | — | page 648, right column | — |
| 3. Spectral Sensitizers and Supersensitizers | pages 23–24 | page 648, right column to page 649, right column | pages 24–28 |
| 4. Brightening Agents | page 24 | — | — |
| 5. Antifoggants and Stabilizers | pages 24–25 | page 649, right column | pages 24 and 31 |
| 6. Light Absorbers, Filter Dyes, and Ultraviolet Absorbers | pages 25–26 | page 649, right column to page 650, left column | — |
| 7. Antistaining Agents | page 25, right column | page 650, left to right columns | — |
| 8. Dye image Stabilizers | page 25 | — | page 32 |
| 9. Hardening Agents | page 26 | page 651, left column | page 32 |
| 10. Binders | page 26 | page 651, left column | page 28 |
| 11. Plasticizers and Lubricants | page 27 | page 650, right column | — |
| 12. Coating Aids and Surfactants | pages 26–27 | page 650, right column | — |
| 13. Antistatic Agents | page 27 | page 650, right column | — |
| 14. Color Couplers | page 25 | page 649 | page 31 |

As gelatin hardening agents, active halide compounds (e.g., 2,4-dichloro-6-hydroxy-1,3,5-triazine and sodium salts thereof) and active vinyl compounds (e.g., 1,3,-bisvinylsulfonyl-2-propanol, 1,2-bis(vinylsulfonylacetamido)ethane, or vinyl polymers having a vinylsulfonyl group at the side chain) are preferred because they rapidly harden hydrophilic colloid such as gelatin and provide stable photographic characteristics. N-carbamoyl pyridinium salts (e.g., 1-morpholinocarbonyl-3-pyridinio) methanesulfonate) and haloamidinium salts (e.g., 1(1-chloro-1-pyridinomethylene)pyrrolidinium 2-naphthalenesulfonate) can also be preferably used as they are also excellent in view of rapid hardening ability.

Color photographic materials can be development processed according to ordinary methods disclosed in *RD,* Vol. 176, No. 17643, and ibid., Vol. 187, No. 18716. Color photographic materials are in general subjected to washing processing or stabilization processing after development, blixing or fixation processing. Washing processing is usually performed in a countercurrent system by two or more tanks with a view to saving water. As stabilization processing, multistage countercurrent stabilization processing as disclosed in JP-A-57-8543 is representatively used instead of washing processing.

In addition to the above, as to the color couplers for use in the present invention, JP-A-11-65007, paragraphs from 0019 to 0024, as to the chemical sensitization, the same patent, paragraphs from 0041 to 0053, as to the antifoggants, the same patent, paragraph 0057, as to the sensitizing dyes, the same patent, paragraphs from 0058 to 0060, as to the development process, the same patent, paragraphs from 0080 to 0099, and as to the application to the APS system, the same patent, paragraphs from 0100 to 0126 can be referred to, respectively.

EXAMPLE

The present invention will be described in detail with reference to specific examples but the present invention should not be construed as being limited thereto.

Example 1

Synthesis of Compound (S-3)

Compound (S-3) was synthesized according to the following reaction scheme 1.

Reaction Scheme 1

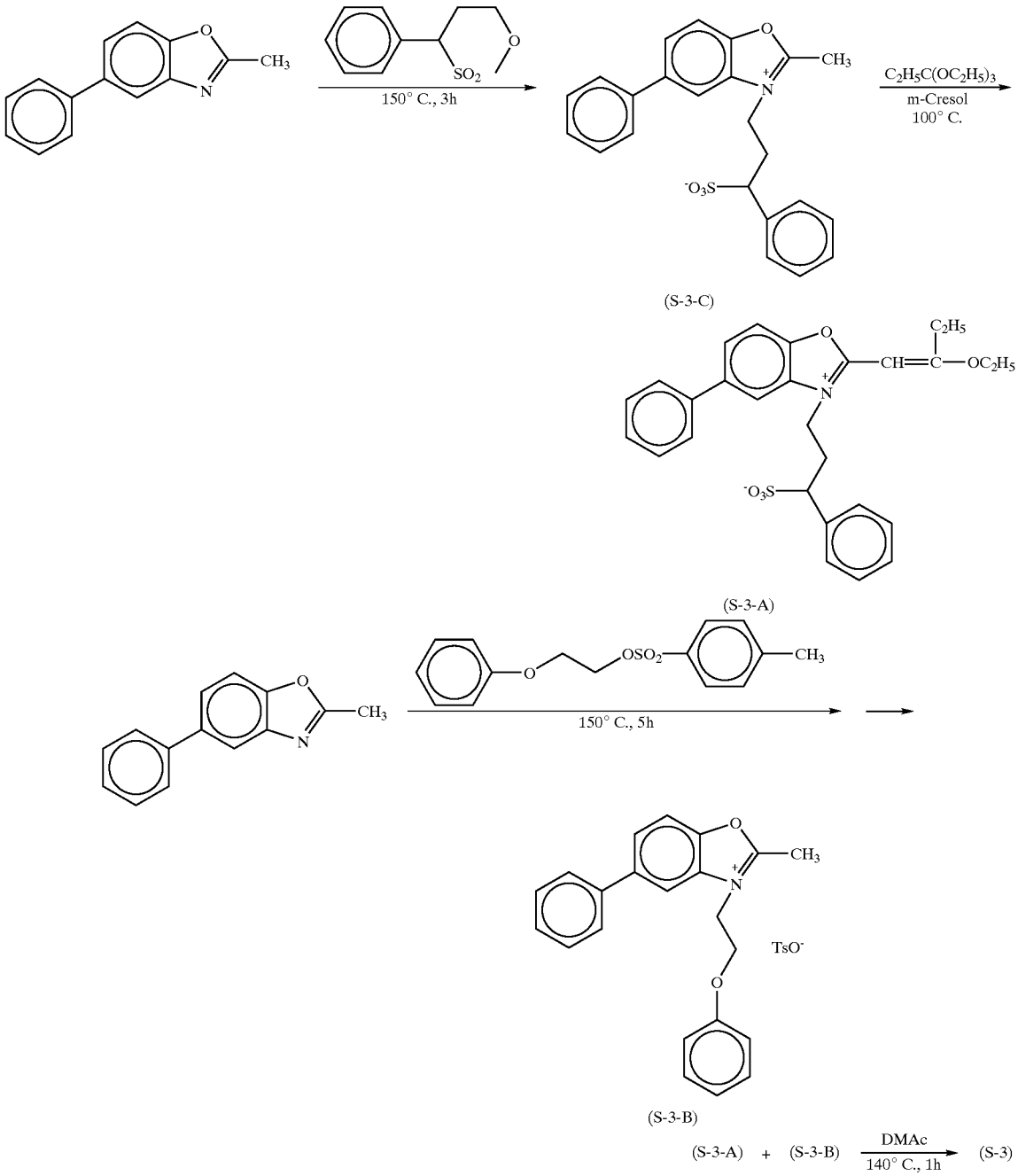

Synthesis of Compound (S-3-C)

Ten (10) grams of 5-phenyl-2-methylbenzoxazole and 11 g of 1-phenylpropanesultone were mixed and stirred at 150° C. for 3 hours. After cooling the reaction mixture, 100 ml of ethyl acetate was added thereto, followed by stirring at room temperature for 2 hours. The resulted crystals were filtered and dried, thereby 18.59 g of Compound (S-3-C) was obtained (yield: 95%).

Synthesis of Compound (S-3-A)

Ten (10) grams of Compound (S-3-C), 10 g of triethyl-o-propionic acid and 10 ml of m-cresol were stirred at 100° C. of outer temperature for 1 hour. After cooling the reaction solution with water, 100 ml of ethyl acetate was added thereto, followed by stirring at room temperature for 1 hour. The resulted crystals were filtered and dried under reduced pressure, thereby 8.1 g of Compound (S-3-A) was obtained (yield: 67%, λmax=334 nm).

Synthesis of Compound (S-3-B)

Seventy-two (72) grams of 5-phenyl-2-methylbenzoxazole and 100 g of 2-phenoxyethyltosylate were mixed and stirred at 150° C. for 8 hours. After cooling the reaction mixture, 400 ml of ethyl acetate was added thereto, followed by stirring at room temperature for2 hours. The resulted crystals were filtered and dried, thereby 150 g of Compound (S-3-B) was obtained (yield: 87%).

Synthesis of Compound (S-3)

One point zero (1.0) gram of Compound (S-3-A) and 0.91 g of Compound (S-3-B) were mixed to 30 ml of N,N-dimethylacetamide and the reaction mixture was stirred at 140° C. of outer temperature for 1 hour. After cooling the reaction solution, 100 ml of ethyl acetate and 100 ml of hexane were added thereto, and the reaction mixture was stirred at room temperature, thereby an oily substance was separated. The oily substance was taken out by decantation and purified by silica gel column chromatography ($SiO_2$: 150 g, dichloromethane/methanol=20→10), thereby 0.3 g of Compound (S-3) was obtained (yield: 22%, λ max (MeOH)=505.6 nm, melting point: 232° C.)

Example 2

Preparation of Pure Silver Bromide Tabular Grain Emulsion and Silver Iodobromide Tabular Grain Emulsion In 1.2 liters of water were dissolved 6.4 g of potassium bromide and 6.2 g of low molecular weight gelatin having an average molecular weight of 15,000 or less, and 8.1 ml of a 16.4% aqueous silver nitrate solution and 7.2 ml of a 23.5% aqueous potassium bromide solution were added thereto by a double jet method over 10 seconds while maintaining the temperature at 30° C. Then, a 11.7% aqueous gelatin solution was further added to the reaction solution and ripening was performed for 40 minutes by increasing the temperature to 75° C., followed by the addition of 370 ml of a 32.2% aqueous silver nitrate solution and a 20% aqueous potassium bromide solution over 10 minutes with maintaining the silver potential at −20 mV. Physical ripening was performed for 1 minute and then the temperature was lowered to 35° C. Thus, a monodispersed pure silver bromide tabular grain emulsion (specific gravity: 1.15) having an average projected area diameter of 2.32 μm, a thickness of 0.09 μm and a variation coefficient of diameter of 15.1% was obtained.

Soluble salts were removed from the emulsion by a coagulation precipitation method. The temperature of the emulsion was maintained at 40° C., and 45.6 g of gelatin, 10 ml of an aqueous sodium hydroxide solution having concentration of 1 mol/liter, 167 ml of water, and 10 ml of a 5% phenol were added to the emulsion. pAg and pH were adjusted to 6.88 and 6.16, respectively, thereby Emulsion A was obtained.

Emulsion B was prepared in the same manner as in the preparation of Emulsion A except that the 20% aqueous potassium bromide solution used in the tabular grain growth was replaced with a mixed aqueous solution of 17% potassium bromide and 3% potassium iodide.

Subsequently, potassium thiocyanate, chloroauric acid and sodium thiosulfate were added to each of Emulsions A and B, and ripening was performed at 55° C. for 50 minutes so as to be optimally sensitized.

With maintaining each of the thus-obtained emulsions at 50° C., the first dye shown in Table 1 was added to each emulsion and the emulsion was stirred at 50° C. for 30 minutes, and then the second dye was added and stirred at 50° C. for further 30 minutes.

TABLE 1

| | | First Dye | | Second Dye | |
|---|---|---|---|---|---|
| Example No. | Emulsion | Kind | Addition Amount ($10^{-3}$ mol/Ag mol) | Kind | Addition Amount ($10^{-3}$ mol/Ag mol) |
| Comp. Ex. 1 | A | H-1 | 6.60 | None | — |
| Comp. Ex. 2 | A | H-1 | 3.60 | H-2 | 3.00 |
| Comp. Ex. 3 | A | None | — | H-2 | 6.60 |
| Invention 1 | A | H-1 | 3.60 | S-4 | 3.00 |
| Invention 2 | A | S-3 | 6.60 | None | — |
| Invention 3 | A | S-3 | 3.60 | H-2 | 3.00 |
| Invention 4 | A | S-3 | 3.60 | S-5 | 3.00 |
| Invention 5 | B | S-2 | 3.60 | S-4 | 3.00 |

H-1

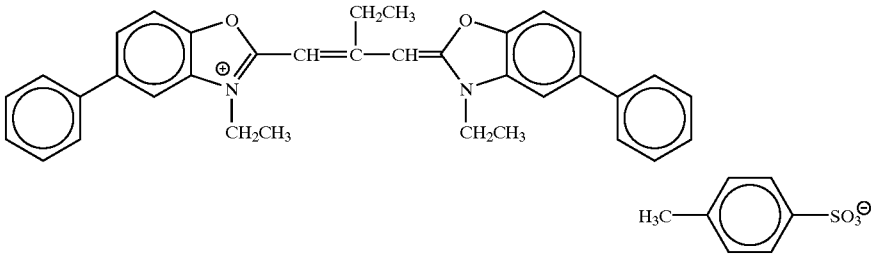

H-2

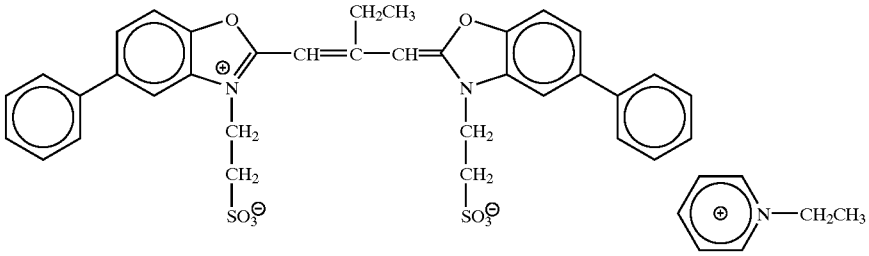

The dye adsorption amount was obtained as follows: The emulsion obtained was centrifuged at 10,000 rpm for 10 minutes to precipitate, and the precipitate was freeze-dried, 25 ml of a 25% aqueous sodium thiosulfate solution and methanol was added to 0.05 g of the precipitate to make the volume 50 ml. This solution was analyzed by a high speed liquid chromatography and dye concentration was determined.

The measurement of the light absorption strength per unit area was conducted as follows: that is, the obtained emulsion was coated thinly on a slide glass and transmission spectrum and reflection spectrum of each grain were measured using a microspectrophotometer ("MSP 65" produced by Carl Zeiss Corp.) according to the following method, from which absorption spectrum was searched for. A portion where grains were not present was taken as a reference of transmission spectrum and silicon carbide the reflectance of which was known was measured and the obtained value was made a reference of reflection spectrum. The measured part was a circular aperture of a diameter of 1 $\mu$m, and transmission spectrum and reflection spectrum were measured in the wave number region of from 14,000 $cm^{-1}$ (714 nm) to 28,000 $cm^{-1}$ (357 nm) by adjusting the position so that the aperture part was not over lapped with the contour of the grain. Absorption spectrum was found taking 1−T (transmittance)−R (reflectance) as absorption rate A, one from which the absorption by silver halide was deducted was taken as absorption A'. The value obtained by integrating −Log (1-A') to wave number (cm_) was divided by 2 and this value was made the light absorption strength per unit surface area. The integrated region was from 14,000 $cm^{-1}$ to 28,000 $cm^{-1}$. A tungsten lamp was used as a light source and the light source voltage was 8 V. For minimizing the injury of the dye by irradiation of light, a primary monochromator was used, the distance of wavelength was 2 nm, and a slit width was 2.5 nm.

The absorption spectrum of the emulsion was obtained as the absorption spectrum of only the dye by converting the infinite diffuse reflectance of the finished emulsion according to the Kubelka-Munk method when the emulsion to which the dye was not added was made a reference.

The coated film was subjected to exposure using a spectral exposure apparatus which was adjusted so that the photon number of each wavelength in the exposure wavelength region became the same and the spectral sensitivity of the coated film was obtained from the exposure amount giving a density of fog +0.2.

A gelatin hardening agent and a coating aid were added to the emulsion obtained, which was coated in a coating silver amount of 3.0 g-Ag/$m^2$ on a cellulose acetate film support with a gelatin protective layer by a simultaneous coating method. The film obtained was subjected to exposure with a tungsten lamp (color temperature: 2,854° K) for 1 second through a continuous wedge color filter. As a color filter, UVD33S filter was combined with V40 filter (a product of Toshiba Glass Co., Ltd.) for blue exposure for exciting silver halide and the sample was irradiated with light of wavelength range of 330 nm to 400 nm. Fuji gelatin filter SC-52 (a product of Fuji Photo Film Co., Ltd.) was used for minus blue exposure for exciting the dye side and the sample was irradiated with the light of 520 nm or less being cut off. The exposed sample was development processed at 20° C. for 10 minutes with the following surface developing solution MAA-1.

Surface Developing Solution MAA-1

| | |
|---|---|
| Metol | 2.5 g |
| L-Ascorbic Acid | 10 g |
| Nabox (a product of Fuji Photo Film Co., Ltd.) | 35 g |
| Potassium Bromide | 1 g |
| Water to make | 1 liter |
| pH | 9.8 |

Optical density of the development processed film was measured using a Fuji automatic densitometer. Sensitivity was the reciprocal of the exposure amount required to give an optical density of fog +0.2 and expressed as a relative value taking Comparison 1 as a control, with fog being the density at the unexposed part.

The results obtained are shown in Tables 2 and 3 below. As is apparent from the results of Table 2, by the addition of the two kinds of dyes according to the present invention, multilayer adsorption onto the grain surface became feasible and the light absorption strength per unit area of a grain surface (½ of the light absorption strength of one grain) was conspicuously increased. Further, as a result, as shown in Table 3, color sensitization sensitivity was markedly increased.

Further, since the light absorption strength can be increased in a narrow wavelength range, high sensitivity can be obtained in only the desired wavelength region.

TABLE 2

| | Light | First Dye | | | Second Dye | | |
|---|---|---|---|---|---|---|---|
| | Absorption Strength per Unit Surface Area | Kind | Adsorption Amount ($10^{-3}$ mol/mol-Ag) | Covering Rate (%) | Kind | Adsorption Amount ($10^{-3}$ mol/mol-Ag) | Covering Rate (%) |
| Comp. Ex. 1 | 83 | H-1 | 1.47 | 98 | None | — | — |
| Comp. Ex. 2 | 82 | H-1 | 1.28 | 85 | H-2 | 0.17 | 11 |
| Comp. Ex. 3 | 76 | None | — | — | H-2 | 1.41 | 94 |
| Invention 1 | 139 | H-1 | 1.32 | 93 | S-4 | 1.06 | 78 |
| Invention 2 | 298 | S-3 | 5.40 | 361 | None | — | — |
| Invention 3 | 231 | S-3 | 3.35 | 230 | H-2 | 0.77 | 58 |
| Invention 4 | 321 | S-3 | 3.33 | 228 | S-5 | 2.39 | 159 |
| Invention 5 | 303 | S-2 | 3.01 | 198 | S-4 | 2.30 | 151 |

TABLE 3

| | Blue Sensitivity | Minus Blue Sensitivity | Color Sensitization Sensitivity (minus blue sensitivity/ blue sensitivity) | Absorption Width *1 (80%, 50% of Amax) | Spectral Sensitivity Width (80%, 50% of Smax) |
|---|---|---|---|---|---|
| Comp. Ex. 1 | 100 | 100 | 100 | 49, 111 | 42, 103 |
| Comp. Ex. 2 | 97 | 99 | 102 | 56, 102 | 48, 101 |
| Comp. Ex. 3 | 95 | 96 | 101 | 55, 108 | 49, 110 |
| Invention 1 | 93 | 136 | 135 | 48, 119 | 48, 101 |
| Invention 2 | 95 | 189 | 198 | 49, 106 | 48, 101 |
| Invention 3 | 96 | 175 | 179 | 23, 111 | 44, 99 |
| Invention 4 | 99 | 228 | 231 | 21, 92 | 43, 92 |
| Invention 5 | 98 | 205 | 208 | 22, 91 | 41, 93 |

*1 The value obtained from the spectrum after converting the diffuse reflection spectrum of the emulsion according to the Kubelka-Munk method.

EFFECT OF THE INVENTION

According to the present invention, a high speed silver halide photographic material can be obtained.

While the invention has been described in detail and with reference to specific examples thereof, it will be apparent to one skilled in the art that various changes and modifications can be made therein without departing from the spirit and scope thereof.

What is claimed is:

1. A silver halide photographic emulsion which contains silver halide grains spectrally sensitized by at least one sensitizing dye, wherein said at least one sensitizing dye is absorbed on the grain surface in more than one layer, and the silver halide grains have a spectral absorption maximum wavelength of less than 500 nm and a light absorption strength of 60 or more, or a spectral absorption maximum wavelength of 500 nm or more and a light absorption strength of 100 or more, wherein at least one of the sensitizing dyes which are used for spectrally sensitizing the emulsion does not have an electric charge in the molecule at all, or forms an inner salt and the molecule does not have an electric charge as a whole and has at least one aromatic ring in the molecule.

2. The silver halide photographic emulsion as claimed in claim 1, wherein said sensitizing dye is a compound represented by the following formula (I):

(I)

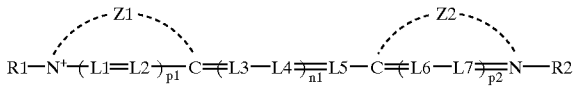

wherein Z1 and Z2 each represents an atomic group necessary to form a 5- or 6-membered nitrogen-containing heterocyclic ring, provided that Z1 and Z2 may be condensed with a ring; R1 and R2 each represents an alkyl group, an aryl group, or a heterocyclic group, and at least one of R1 and R2 is a group containing at least one aromatic group; L1, L2, L3, L4, L5, L6 and L7 each represents a methine group; p1 and p2 each represents 0 or 1; and n1 represents 0, 1, 2 or 3; provided that the dye represented by formula (I) has at least one anionic substituent necessary to form an inner salt and does not have electric charge as a whole.

3. The silver halide photographic emulsion as claimed in claim 1 or 2, wherein when the maximum value of the spectral absorption rate of all dyes absorbed on said grains is taken as A max, the wavelength interval between the shortest wavelength and the longest wavelength showing 80% absorption of A max, is 20 nm or more and the wavelength interval between the shortest wavelength and the longest wavelength showing 50% absorption of A max is 120 nm or less.

4. The silver halide photographic emulsion as claimed in claim 1 or 2, wherein when the maximum value of the spectral sensitivity of said grains is taken as S max, the wavelength interval between the shortest wavelength and the longest wavelength showing 80% sensitivity of S max is 20 nm or more and the wavelength interval between the shortest wavelength and the longest wavelength showing 50% sensitivity of S max is 120 nm or less.

5. The silver halide photographic emulsion as claimed in claim 3, wherein the longest wavelength showing the spectral absorption rate of 50% of A max is from 460 to 510 nm, or from 560 to 610 nm, or from 640 to 730 nm.

6. The silver halide photographic emulsion as claimed in claim 4, wherein the longest wavelength showing the spectral sensitivity of 50% of S max is 460 to 510 nm, or from 560 to 610 nm, or from 640 to 730 nm.

7. A silver halide photographic material which has at least one silver halide photographic emulsion layer, wherein said silver halide photographic material contains the silver halide photographic emulsion as claimed in claim 1 or 2.

8. The silver halide photographic material as claimed in claim 2, wherein R1 and R2 each represents a group containing at least one aromatic group.

9. A silver halide photographic material which has at least one silver halide photographic, emulsion layer, wherein said silver halide photographic material contains the silver halide photographic emulsion as claimed in claim 3.

10. A silver halide photographic material which has at least one silver halide photographic emulsion layer, wherein said silver halide photographic material contains the silver halide photographic emulsion as claimed in claim 4.

11. A silver halide photographic material which has at least one silver halide photographic emulsion layer, wherein said silver halide photographic material contains the silver halide photographic emulsion as claimed in claim 5.

12. A silver halide photographic material which has at least one silver halide photographic emulsion layer, wherein said silver halide photographic material contains the silver halide photographic emulsion as claimed in claim 6.

* * * * *